US011250762B2

(12) United States Patent
Nam et al.

(10) Patent No.: US 11,250,762 B2
(45) Date of Patent: Feb. 15, 2022

(54) DISPLAY DEVICE

(71) Applicant: SAMSUNG DISPLAY CO., LTD., Yongin-si (KR)

(72) Inventors: Yang Uk Nam, Yongin-si (KR); Sung Chun Park, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/016,998

(22) Filed: Sep. 10, 2020

(65) Prior Publication Data

US 2021/0280121 A1 Sep. 9, 2021

(30) Foreign Application Priority Data

Mar. 4, 2020 (KR) ..... 10-2020-0027302

(51) Int. Cl.
*G09G 3/20* (2006.01)
*G09G 3/32* (2016.01)

(52) U.S. Cl.
CPC ..... *G09G 3/2007* (2013.01); *G09G 3/32* (2013.01); *G09G 2300/08* (2013.01); *G09G 2310/027* (2013.01); *G09G 2310/0267* (2013.01); *G09G 2310/0286* (2013.01); *G09G 2310/0291* (2013.01); *G09G 2310/08* (2013.01); *G09G 2330/023* (2013.01); *G09G 2330/028* (2013.01)

(58) Field of Classification Search
CPC ..... G09G 2330/021; G09G 2320/0673; G06F 1/3265; G06F 1/3296
See application file for complete search history.

(56) References Cited

U.S. PATENT DOCUMENTS 8,698,854 B2 4/2014 Lee
2016/0189608 A1* 6/2016 Park ..... G09G 3/3275 345/212

(Continued)

FOREIGN PATENT DOCUMENTS

KR 100724860 B1 6/2007
KR 101323390 B1 10/2013

(Continued)

OTHER PUBLICATIONS

Unpublished (U.S. Appl. No. 17/101,285) was mentioned in search report dated Dec. 26, 2019; a legible copy of the specification, including the claims, and drawings of pending U.S. application is submitted herewith.

*Primary Examiner* — Gerald Johnson
(74) *Attorney, Agent, or Firm* — Cantor Colburn LLP

(57) ABSTRACT

A display device includes a display panel including a plurality of pixels and a power line, and displaying an image in a normal mode or a power saving mode, a data driver which provides a data signal to the pixels, and a power supply which supplies a source driving voltage to the data driver and supplies a first power voltage to the power line in the normal mode. The data driver supplies a first auxiliary power voltage to the power line in the power saving mode, and the power supply outputs the first power voltage by decreasing a voltage level of the first power voltage to a first power saving voltage level in a vertical blank period in which the pixels do not display an image during a first switching period changing from the normal mode to the power saving mode.

20 Claims, 13 Drawing Sheets

(56) References Cited

U.S. PATENT DOCUMENTS

| | | | | |
|---|---|---|---|---|
| 2017/0116922 | A1* | 4/2017 | Jung | G09G 3/3258 |
| 2017/0147063 | A1* | 5/2017 | Lim | G09G 3/3685 |
| 2017/0148390 | A1* | 5/2017 | Park | G09G 3/3225 |
| 2018/0024619 | A1* | 1/2018 | Kasuo | G06F 1/3228 345/589 |
| 2019/0028654 | A1* | 1/2019 | Misawa | G03B 17/18 |
| 2019/0172379 | A1 | 6/2019 | Park et al. | |
| 2019/0228694 | A1 | 7/2019 | Lee et al. | |

FOREIGN PATENT DOCUMENTS

| | | | |
|---|---|---|---|
| KR | 1020190066104 | A | 6/2019 |
| KR | 1020190090899 | A | 8/2019 |

* cited by examiner

DISPLAY DEVICE

This application claims priority to Korean Patent Application No. 10-2020-0027302, filed on, Mar. 4, 2020, and all the benefits accruing therefrom under 35 U.S.C. § 119, the content of which in its entirety is herein incorporated by reference.

BACKGROUND

1. Field

The disclosure relates to a display device.

2. Description of the Related Art

A driving frequency of pixels of a display device may vary according to a display mode. For example, in a normal image display mode (normal mode), the pixels may be driven at a relatively high frequency. In addition, in a standby mode (power saving mode) displaying only minimal information (for example, time), the pixels may be driven at a relatively low frequency.

Various solutions are being studied to decrease power consumption of the display device when the pixels of the display device are driven at a low frequency. However, when such solutions are applied, a side effect may occur in which a luminance deviation due to a rapid voltage or current change is recognized by a user in a process of changing the driving frequency.

SUMMARY

Features and/or advantages of the disclosure are to provide a display device that minimizes a luminance deviation that may occur when a display mode is switched.

In addition, another feature and/or advantage of the disclosure is to provide a display device capable of further decreasing power consumption in a low power display mode.

The features and/or advantages of the disclosure are not limited to the above-described features and/or advantages, and other technical features and/or advantages that are not described will be clearly understood by those skilled in the art from the following description.

A display device according to an embodiment of the disclosure includes a display panel which includes a plurality of pixels and a power line, and displays an image in a normal mode or a power saving mode, a data driver which provides a data signal to the pixels, and a power supply which supplies a source driving voltage to the data driver and supply a first power voltage to the power line in the normal mode. The data driver supplies a first auxiliary power voltage to the power line in the power saving mode, the power supply outputs the first power voltage by decreasing a voltage level of the first power voltage to a first power saving voltage level in a vertical blank period of a first switching period, the pixels do not display an image in the vertical blank period, and the first switching period is a transition period from the normal mode to the power saving mode.

The power supply may include a first converter which generates the first power voltage, the first converter may include a switch unit including a first inductor and first and second transistors and connected between a first input terminal to which an external input voltage is applied and a first output terminal from which the first power voltage is output, and a discharge circuit connected between the first output terminal and ground and including a variable resistor and a discharge transistor, and the first converter may alternately turn on the first and second transistors to output the first power voltage.

The discharge transistor may be turned on in response to a discharge control signal provided in the vertical blank period, and the first converter may decrease the voltage level of the first power voltage to the first power saving voltage level after the discharge control signal is provided.

The power supply may include a second converter which generates the source driving voltage, the second converter may include a second inductor connected between a second input terminal to which an external input voltage is applied and a node, a third transistor connected between the node and ground and which is turned on in response to a first control signal, a fourth transistor connected between a second output terminal from which the source driving voltage is output and the node and which is turned on in response to a second control signal, and a switching controller which generates a switching control signal including the first control signal and the second control signal, and a first period in which the switching control signal is provided in the normal mode may be different from a second period in which the switching control signal is provided in the power saving mode.

The second period may be set to be longer than the first period.

In the power saving mode, when a ripple voltage of the source driving voltage is equal to or less than a first set value, the switching controller may turn on the third transistor or the fourth transistor, and when the ripple voltage of the source driving voltage is equal to or greater than a second set value, the switching controller may turn off the third transistor and the fourth transistor.

The display panel may display a normal image in the normal mode, and display a power saving image having a load less than a load of the normal image in the power saving mode, the pixels may display the normal image at a first driving frequency in the normal mode, and the pixels may display the power saving image at a second driving frequency less than the first driving frequency in the power saving mode.

The display device may further include a gate driver which provides a gate signal to the pixels, the data driver may generate the first auxiliary power voltage and a gate driving voltage based on the source driving voltage, and the gate driver may generate the gate signal based on the gate driving voltage.

When switching from the normal mode to the power saving mode, the power supply may output the source driving voltage by decreasing a voltage level of the source driving voltage to a second power saving voltage level during a first period, the data driver may output the gate driving voltage by decreasing a voltage level of the gate driving voltage to a third power saving voltage level during a second period shorter than the first period, and a difference between the voltage level of the source driving voltage and the voltage level of the gate driving voltage may maintain a preset reference value or more.

The voltage level of the source driving voltage may gradually decrease in a stepped manner over the first period.

When the source driving voltage and the gate driving voltage decrease, a slew rate of the source driving voltage may be less than a slew rate of the gate driving voltage.

The power supply may output the source driving voltage by decreasing a voltage level of the source driving voltage in the power saving mode after the first switching period, and the data driver may output the gate driving voltage by decreasing a voltage level of the gate driving voltage in the first switching period.

The power supply may decrease the voltage level of the source driving voltage in a next frame after the voltage level of the gate driving voltage decreases.

The power supply may increase the voltage level of the source driving voltage in response to a mode control signal in the power saving mode, and the data driver may increase the voltage level of the gate driving voltage in a second switching period changing from the power saving mode to the normal mode.

The data driver may provide a black image data signal to the pixels in the first switching period.

A display device according to another embodiment of the disclosure includes a display panel which includes a plurality of pixels and a power line and displays an image in a normal mode or a power saving mode, a data driver which provides a data signal to the pixels, and a power supply which supplies a source driving voltage to the data driver and supplies a first power voltage to the power line in the normal mode. The data driver generates a first auxiliary power voltage and a first gamma voltage based on an external input voltage and the source driving voltage, the data driver supplies the first auxiliary power voltage to the power line in the power saving mode, in a period changing from the normal mode to the power saving mode, the data driver outputs the first gamma voltage by decreasing a voltage level of the first gamma voltage, and the power supply outputs the first power voltage by decreasing a voltage level of the first power voltage, and in the normal mode and the power saving mode, a difference between the voltage level of the first power voltage and the voltage level of the first gamma voltage is constant.

The data driver may include a power converter which generates the first auxiliary power voltage and the first gamma voltage using the source driving voltage, a grayscale voltage generator which generates grayscale voltages based on the first gamma voltage, and a data signal generator which generates the data signal based on the grayscale voltages and the source driving voltage.

The data driver may further include a gap controller which generates a second gamma voltage of which a voltage level is adjusted based on the first gamma voltage, the first power voltage, and a reference power voltage, and the grayscale voltage generator may generate the grayscale voltages based on the second gamma voltage.

The gap controller may include a first driver which compares the first gamma voltage with the first power voltage to generate a reference voltage difference, a second driver which sums the reference voltage difference and the reference power voltage to generate a reference gamma voltage, and a third driver which outputs the second gamma voltage based on the reference gamma voltage.

The third driver may include an amplifier including a first input terminal connected to the second driver to receive the reference gamma voltage, a second input terminal which receives a feedback voltage of the second gamma voltage, and an output terminal which outputs the second gamma voltage, and a voltage divider connected to the output terminal and the second input terminal and which provides the feedback voltage of the second gamma voltage to the second input terminal of the amplifier.

Specific details of other embodiments are included in the detailed description and drawings.

The display device according to embodiments of the disclosure may minimize power consumption by applying the first power voltage and the second power voltage to the display panel through the power supply in the normal mode, and supplying the first auxiliary power voltage and the second auxiliary power voltage through the data driver in the power saving mode.

In addition, the display device according to embodiments of the disclosure may minimize power consumption by decreasing a voltage level (or an absolute value of a voltage level) of voltages generated by the power supply and the data driver in the power saving mode.

In addition, the display device according to embodiments of the disclosure may prevent a luminance difference of a display image between the normal mode and the power saving mode due to a power voltage level change from being recognized to a user, by rapidly decreasing the voltage level of the first power voltage to the first power saving voltage level in the vertical blank period in which an image is not displayed.

In addition, the display device according to embodiments of the disclosure may maintain the difference of the voltage level of the source driving voltage and the voltage level of the first gate driving voltage at the preset reference value or more and smoothly generate and supply voltages, by sequentially decreasing the voltage level of the source driving voltage for a period longer than that of the voltage level of the first gate driving voltage.

In addition, the display device according to embodiments of the disclosure may minimize power consumption by decreasing the number of switching per unit time of transistors of the power supply in the power saving mode.

The effect according to the embodiments is not limited by the details exemplified above, more various effects are included in the present specification.

BRIEF DESCRIPTION OF THE DRAWINGS

The above and other features of the disclosure will become more apparent by describing in further detail embodiments thereof with reference to the accompanying drawings, in which.

DETAILED DESCRIPTION

Figure 1:
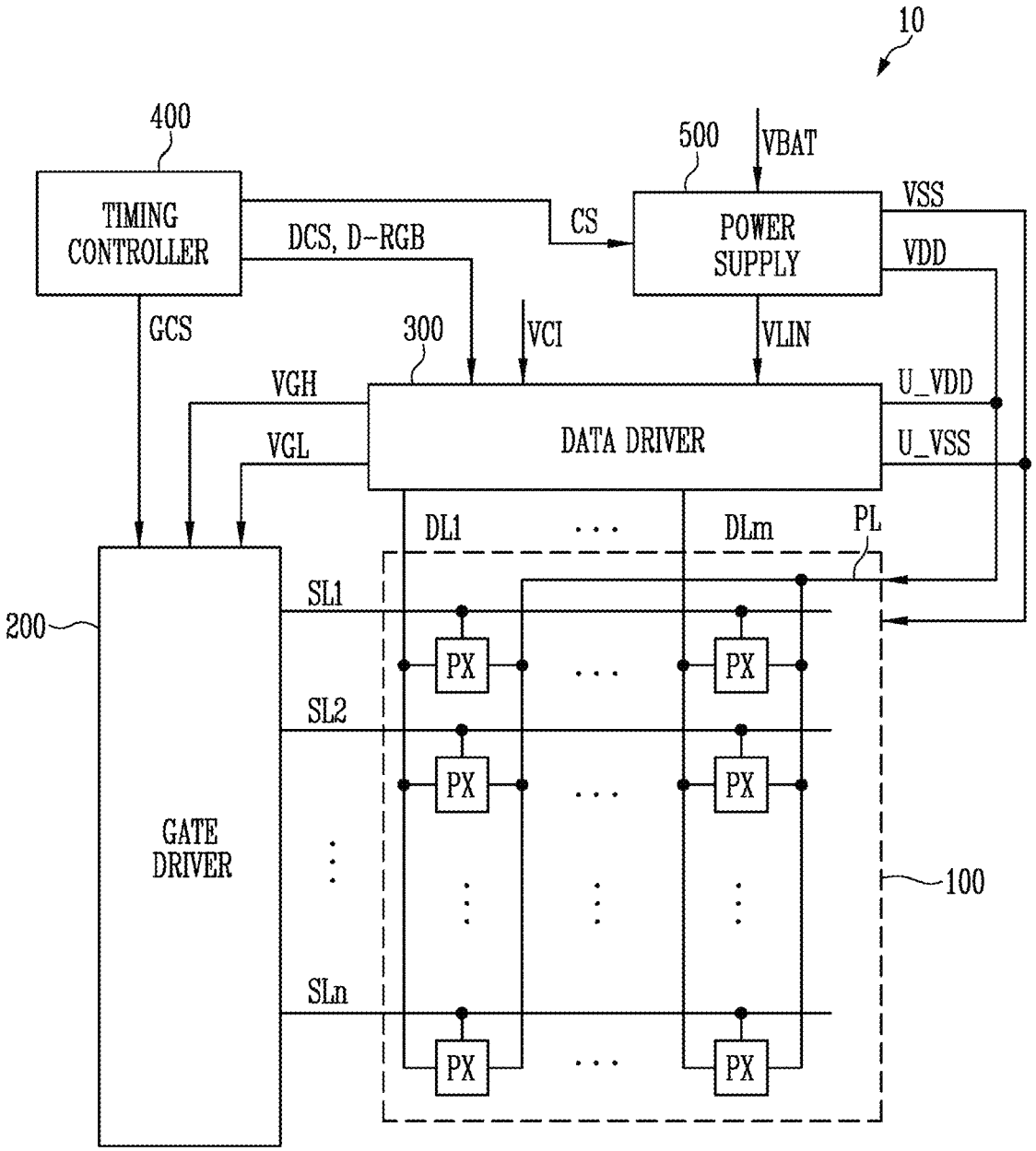
FIG. 1 is a diagram illustrating a display device according to an embodiment of the disclosure.

The advantages and features of the disclosure and a method of achieving them will become apparent with reference to the embodiments described in detail below together with the accompanying drawings. However, the disclosure according to the invention is not limited to the embodiments disclosed below, and may be implemented in various different forms. The present embodiments are provided so that the disclosure will be thorough and complete and those skilled in the art to which the disclosure pertains can fully understand the scope of the disclosure. The disclosure is only defined by the scope of the claims.

The same reference numerals denote to the same components throughout the specification. A shape, a size, a ratio, an angle, the number, and the like disclosed in the drawings for describing the embodiments are exemplary, and thus, the disclosure according to the invention is not limited thereto.

Although a first, a second, and the like are used to describe various components, these components are not limited by these terms. These terms are used only to distinguish one component from another component. Therefore, a first component mentioned below may be a second component within the technical spirit of the disclosure. Singular expressions include plural expressions unless the context clearly indicates otherwise. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Each of features of various embodiments of the disclosure may be coupled or combined with each other in part or in whole, and technically various interlocking and driving are possible. Each embodiment may be implemented independently of each other and association thereof may be implemented together.

Hereinafter, embodiments of the disclosure will be described in detail with reference to the accompanying drawings.

FIG. 1 is a diagram illustrating a display device according to an embodiment of the disclosure.

Referring to FIG. 1, the display device 10 includes a display panel 100, a gate driver 200, a data driver 300, a timing controller 400, and a power supply 500.

The display panel 100 may display an image. The display panel 100 may include gate lines SL1 to SLn (n is a natural number equal to or greater than 2), data lines DL1 to DLm (m is a natural number equal to or greater than 2), a power line PL and a pixel PX.

The pixel PX may be positioned in an area partitioned by the gate lines SL1 to SLn and the data lines DL1 to DLm.

The pixel PX may include a light emitting element, a switching transistor, a driving transistor, and a storage capacitor. The light emitting element may be electrically connected between a line supplying a first power voltage VDD and a line supplying a second power voltage VSS. Here, the first power voltage VDD and the second power voltage VSS may be a high potential voltage and a low potential voltage required for driving the pixel PX, respectively. The first power voltage VDD may have a voltage level greater than a voltage level of the second power voltage VSS, and may be provided through the power line PL. The light emitting element may be an organic light emitting element or an inorganic light emitting element. The switching transistor may transfer a data signal provided through one of the data lines DL1 to DLm to the storage capacitor in response to a gate signal provided through one of the gate lines SL1 to SLn. The storage capacitor may store a data signal. The driving transistor may be connected between the power line PL supplying the first power voltage VDD and the light emitting element, and may transfer a driving current corresponding to the data signal from the power line PL supplying the first power voltage VDD to the light emitting element.

The display panel 100 is described as being an organic light emitting display panel or an inorganic light emitting display panel, but the display panel 100 according to the invention is not limited thereto. For example, the display panel 100 may be implemented as a liquid crystal display panel, and may control an emission amount of light provided from a light source in another embodiment.

In embodiments, the display panel 100 may display an image in a normal mode (or a first mode) or a power saving mode (or a second mode).

The display panel 100 may display a normal image (for example, a video) in the normal mode, and display a power saving image (for example, an image of which a load is less such as a clock) in the power saving mode. Since the power saving image may require relatively less power than the normal image, power consumption in the power saving mode may be minimized.

The power saving mode may minimize power consumption by limiting a maximum luminance of the display panel 100 to a preset luminance or less. For example, the power saving mode may be an always on display ("AOD") mode that always displays simple display information, a predetermined display mode that displays a screen at an ultra-low luminance in a dark environment, and the like.

In the normal mode and the power saving mode, the pixels PX of the display panel 100 may display the image at different driving frequencies. As an embodiment, in the normal mode, the pixels PX may display the normal image at a first driving frequency, and in the power saving mode, the pixels PX may display the power saving image at a second driving frequency less than the first driving frequency. The first driving frequency may be equal to or greater than 20 Hz (for example, 60 Hz), and the second driving frequency may be less than 20 Hz (for example, 1 Hz).

In the power saving mode, an operation of some components included in the display device 10 may be entirely or partially changed compared to the normal mode. Accordingly, unnecessary power consumption may decrease by cutting off or minimizing power supply to various functional blocks that are not used in the power saving mode. The normal mode and the power saving mode may be determined by a mode selection signal provided from the outside, or may be determined by the timing controller 400 based on an image provided from the outside.

The gate driver 200 may receive a gate control signal GCS from the timing controller 400, generate the gate signal based on the gate control signal, and sequentially provide the gate signal to the gate lines SL1 to SLn.

The data driver 300 may receive a data control signal DCS and image data D-RGB from the timing controller 400, generate a data signal corresponding to the image data D-RGB, and provide the data signal to the data lines DL1 to DLm.

In addition, the data driver 300 may receive a source driving voltage VLIN from the power supply 500, generate a first gate driving voltage VGH and a second gate driving voltage VGL based on a first external input voltage VCI provided from the outside and the source driving voltage VLIN, and provide the first gate driving voltage VGH and the second gate driving voltage VGL to the gate driver 200.

One of the first gate driving voltage VGH and the second gate driving voltage VGL may have a turn-on voltage level that turns on a transistor included in the data driver 300 and the gate driver 200, and the other of the first gate driving voltage VGH and the second gate driving voltage VGL may have a turn-off voltage level that turns off the transistor included in the data driver 300 and the gate driver 200.

In embodiments, the data driver 300 may generate a first auxiliary power voltage U_VDD and a second auxiliary power voltage U_VSS based on the first external input voltage VCI and the source driving voltage VLIN. Here, the first auxiliary power voltage U_VDD may have a voltage level equal to or similar to a voltage level of the first power voltage VDD, and the second auxiliary power voltage U_VSS may have a voltage level equal to or similar to a voltage level of the second power voltage VSS.

For example, the data driver 300 may generate the first gate driving voltage VGH, the second gate driving voltage VGL, the first auxiliary power voltage U_VDD, and the second auxiliary power voltage U_VSS through a power converter including a boosting circuit and a regulating circuit.

In addition, the data driver 300 may provide the first auxiliary power voltage U_VDD and the second auxiliary power voltage U_VSS generated in the power saving mode to the display panel 100. The first auxiliary power voltage U_VDD may be provided to the pixel PX through the power line PL.

The data driver 300 may block connection to the display panel 100 or a current movement path from the display panel 100 in the normal mode. For example, in the normal mode, the data driver 300 may increase an impedance of an output terminal outputting the first auxiliary power voltage U_VDD and the second auxiliary power voltage U_VSS so as to block transfer of the first auxiliary power voltage U_VDD and the second auxiliary power voltage U_VSS to the display panel 100.

The timing controller 400 may control the gate driver 200, the data driver 300, and the power supply 500. The timing controller 400 may receive a control signal (for example, a control signal including a clock signal) from the outside, and generate the gate control signal GCS and the data control signal DCS based on the control signal from the outside. In addition, the timing controller 400 may generate a power control signal CS and provide power control signal CS to the power supply 500. In this case, the power supply 500 may determine a driving method (or a voltage control method) based on the power control signal CS. As another embodiment, the timing controller 400 may further provide the power control signal CS to the data driver 300. In this case, the data driver 300 may determine the driving method (or a voltage control method) based on the power control signal CS.

The timing controller 400 may rearrange input data (or raw image data) provided from the outside (for example, a graphic processor) to generate the image data D-RGB, and provide the image data D-RGB to the data driver 300.

The power supply 500 may generate the first power voltage VDD, the second power voltage VSS, and the source driving voltage VLIN based on a second external input voltage VBAT provided from an external power. The power supply 500 may provide the source driving voltage VLIN to the data driver 300. The power supply 500 may provide the first power voltage VDD and the second power voltage VSS to the display panel 100 in the normal mode. The first power voltage VDD may be provided to the pixel PX through the power line PL. Similar to the data driver 300, the power supply 500 may cut off the connection to the display panel 100 in the power saving mode, and stop supply of the first power voltage VDD and the second power voltage VSS to the display panel 100 in the power saving mode.

In embodiments, the power supply 500 may be driven differently in the normal mode and the power saving mode. For example, a voltage level of the voltages generated by the power supply 500 may be changed in the power saving mode compared to the normal mode. The power supply 500 may decrease the voltage level of the first power voltage VDD to a first power saving voltage level in the power saving mode. In addition, the power supply 500 may decrease the voltage level of the source driving voltage VLIN to a second power saving voltage level in the power saving mode.

Similar to the voltages generated by the power supply 500, the voltage level of the voltages generated by the data driver 300 may also be changed in the power saving mode compared to the normal mode. For example, the data driver 300 may decrease the voltage level of the first gate driving voltage VGH to a third power saving voltage level in the power saving mode.

The power supply 500 and the data driver 300 may minimize power consumption of the display device 10 by decreasing the voltage level (or the absolute value of the voltage level) of each of the generated voltages in the power saving mode.

The power supply 500 may rapidly change the voltage level of the first power voltage VDD in a black period (or vertical blank period) in which all pixels PX of the display panel 100 do not display an image. Accordingly, when switching from the normal mode to the power saving mode during the vertical blank period, the display device 10 may prevent a luminance difference of an image between the normal mode and the power saving mode due to the decrease of the first power voltage VDD from being recognized to a user.

As described with reference to FIG. 1, the display device 10 may decrease or minimize power consumption, by applying the first power voltage VDD and the second power voltage VSS to the display panel 100 through the power supply 500 in the normal mode and supplying the first auxiliary power voltage U_VDD and the second auxiliary power voltage U_VSS through the data driver 300 in the power saving mode.

In addition, the display device 10 may decrease or minimize power consumption by decreasing the voltage level (or the absolute value of the voltage level) of each of the voltages generated by the power supply 500 and the data driver 300 in the power saving mode.

Figure 2:
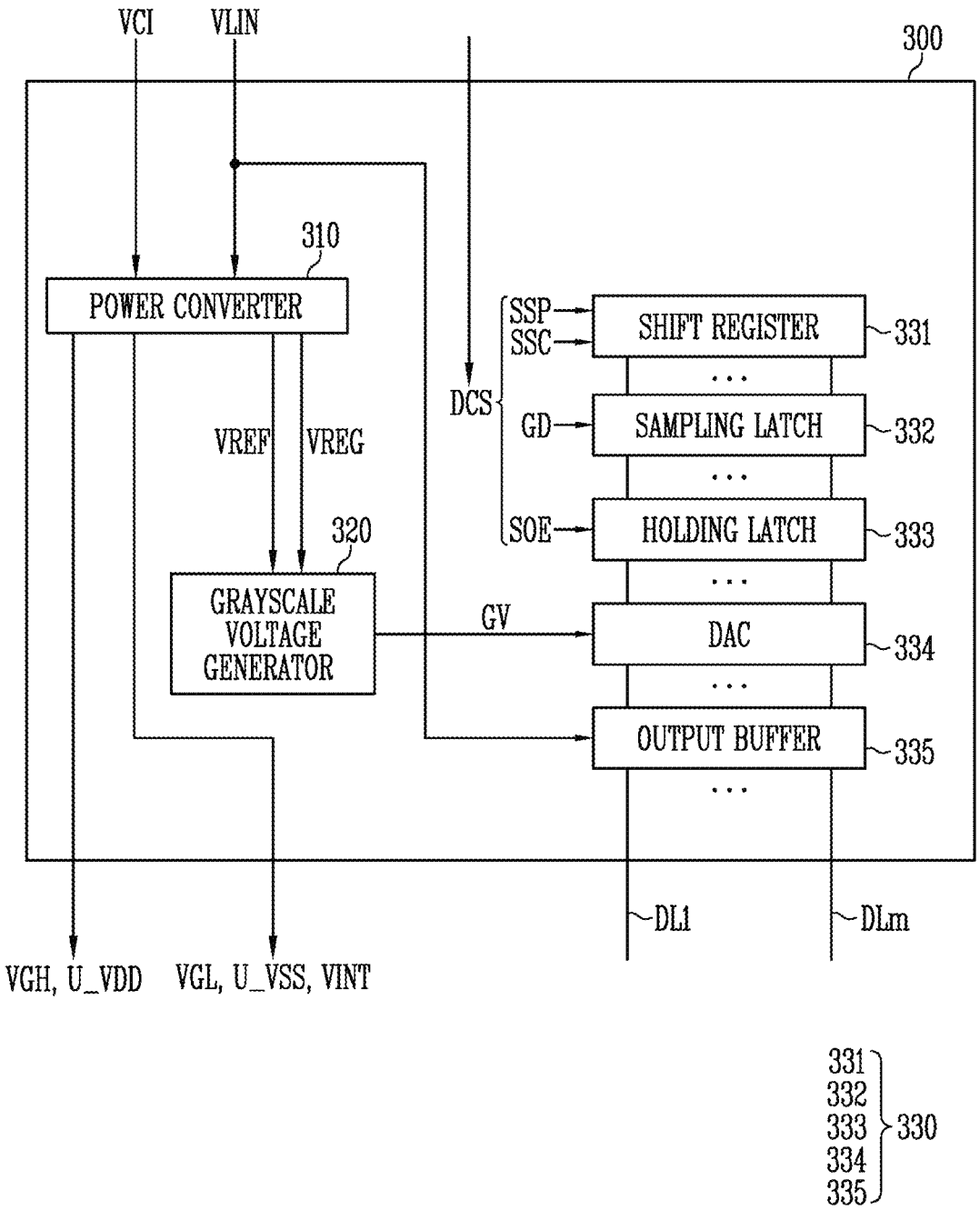
FIG. 2 is a diagram illustrating an example of a data driver included in the display device of FIG. 1.

FIG. 2 is a diagram illustrating an example of the data driver included in the display device of FIG. 1.

The data driver 300 according to an embodiment of the disclosure may include a power converter 310, a grayscale voltage generator 320, and a data signal generator 330.

The power converter 310 may receive the source driving voltage VLIN and convert the source driving voltage VLIN to provide the first gate driving voltage VGH and the second gate driving voltage VGL used for control of the pixel PX to the output terminal. As described above, the first gate driving voltage VGH and the second gate driving voltage VGL may be provided to the gate driver 200.

As an embodiment, when the display device 10 operates in the power saving mode, the power converter 310 may receive the source driving voltage VLIN and convert the source driving voltage VLIN to generate the first auxiliary power voltage U_VDD and the second auxiliary power voltage U_VSS. The first auxiliary power voltage U_VDD and the second auxiliary power voltage U_VSS may be provided to the display panel 100.

The power converter 310 may receive the source driving voltage VLIN and the first external input voltage VCI, and provide a gamma voltage VREG used for the control of the pixel PX to the output terminal based on the source driving voltage VLIN and the first external input voltage VCI. The gamma voltage VREG may be provided to the grayscale voltage generator 320.

Here, a size (or a voltage level) of the gamma voltage VREG may vary according to the display mode (for example, the normal mode and the power saving mode). For example, a voltage level of the gamma voltage VREG of the normal mode may be greater than the voltage level of the gamma voltage VREG of the power saving mode.

The power converter 310 may receive the source driving voltage VLIN and the first external input voltage VCI, and provide a reference voltage VREF used for the control of the pixel PX to the output terminal based on the source driving voltage VLIN and the first external input voltage VCI. The reference voltage VREF may be provided to the grayscale voltage generator 320.

Here, a size (or a voltage level) of the reference voltage VREF may vary according to the display mode (for example, the normal mode and the power saving mode).

The grayscale voltage generator 320 may generate grayscale voltages GV using the gamma voltage VREG and the reference voltage VREF. Since the grayscale voltages GV generated by the grayscale voltage generator 320 are used for display of an image frame, grayscale voltages GV corresponding to a color of the pixels are required to be provided. Therefore, the grayscale voltage generator 320 may include a first color grayscale voltage generator, a second color grayscale voltage generator, and a third color grayscale voltage generator. Here, for example, a first color may be red, a second color may be green, and a third color may be blue.

The data control signal DCS received from the timing controller 400 may be provided to the data signal generator 330. The data control signal DCS may include a source start pulse SSP, a source shift clock SSC, grayscale values GD, a source output enable signal SOE, and the like.

The data signal generator 330 may include a shift register 331, a sampling latch 332, a holding latch 333, a digital-to-analog converter 334, and an output buffer 335.

The shift register 331 may sequentially generate sampling signals while shifting the source start pulse SSP every one period of the source shift clock SSC. The number of sampling signals may correspond to the number of data lines DL1 to DLm. For example, the number of sampling signals may be the same as the number of data lines DL1 to DLm. For another example, when the display device 10 further includes a de-multiplexer between the data driver 300 and the data lines DL1 to DLm, the number of sampling signals may be less than the number of data lines DL1 to DLm. For convenience of description, it is assumed that there is no de-multiplexer in the following description.

The sampling latch 332 may include sampling latch units of the number corresponding to the number of data lines DL1 to DLm, and sequentially receive the grayscale values GD for the image frame from the timing controller 400. The sampling latch 332 may store the grayscale values GD sequentially provided from the timing controller 400 in corresponding sampling latch units, in response to sampling signals sequentially supplied from the shift register 331.

The holding latch 333 may include holding latch units of the number corresponding to the number of data lines DL1 to DLm. The holding latch 333 may store the grayscale values GD, which are stored in the sampling latch units, in the holding latch units when the source output enable signal SOE is input.

The digital-to-analog converter 334 may include the number of digital-to-analog conversion units corresponding to the number of data lines DL1 to DLm. For example, the number of digital-to-analog conversion units may be the same as the number of data lines DL1 to DLm. Each of the digital-to-analog conversion units may apply a grayscale voltage GV corresponding to a grayscale value GD stored in a corresponding holding latch 333 to a corresponding data line.

The output buffer 335 may include buffer units. For example, each of the buffer units may be an operational amplifier. Each of the buffer units may be configured in a form of a voltage follower to apply an output of the digital-to-analog conversion unit to a corresponding data line. For example, an inverting terminal of each of the buffer units may be connected to an output terminal thereof, and a non-inverting terminal may be connected to an output terminal of the digital-to-analog conversion unit. Outputs of the buffer units may be data voltages.

For example, the buffer units may receive a buffer power voltage and a ground power voltage. At this time, the buffer power voltage may be the source driving voltage VLIN. The buffer power voltage may determine an upper limit of an output voltage (that is, the data voltage) of the buffer unit. In addition, the ground power voltage may determine a lower limit of the output voltage of the buffer unit.

Figure 3:
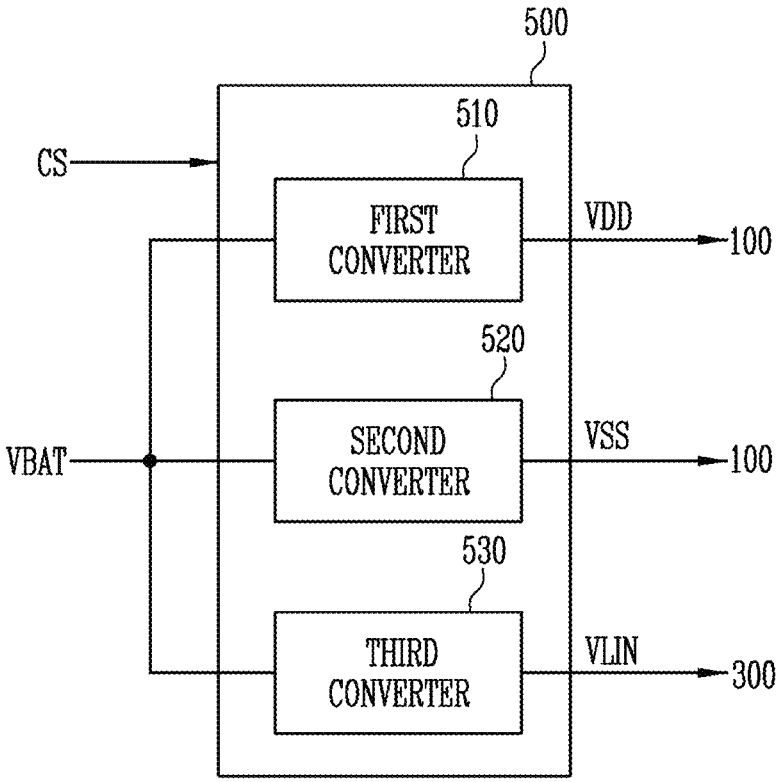
FIG. 3 is a diagram illustrating an example of a power supply included in the display device of FIG. 1.

FIG. 3 is a diagram illustrating an example of the power supply 500 included in the display device of FIG. 1.

Referring to FIG. 3, the power supply 500 may convert the second external input voltage VBAT into the first power voltage VDD, the second power voltage VSS, and the source driving voltage VLIN, and output the first power voltage VDD to the display panel 100, the second power voltage VSS to the display panel 100, and the source driving voltage VLIN to the data driver 300. The power supply 500 may be controlled by the power control signal CS. The power supply 500 may include a first converter 510, a second converter 520, and a third converter 530.

The first converter 510 may convert a voltage of the second external input voltage VBAT to the first power voltage VDD, the second converter 520 may convert the voltage of the second external input voltage VBAT to the second power voltage VSS, and the third converter 530 may convert the voltage of the second external input voltage VBAT to the source driving voltage VLIN. Here, the first converter 510 and the third converter 530 may be boost converters, and the second converter 520 may be an inverting buck boost converter. The first converter 510 and the second converter 520 may operate in the normal mode, and the third converter 530 may operate both in the normal mode and the power saving mode.

As described above, the power supply 500 includes the first converter 510, the second converter 520, and the third converter 530. The first converter 510, the second converter 520, and the third converter 530 are driven in the normal mode, but only the third converter 530 is driven in the power saving mode. Therefore, power consumption may decrease in the power saving mode.

More specific configuration and operation of the first converter 510 and the third converter 530 will be described later with reference to FIGS. 4A and 4B.

Figure 4A:
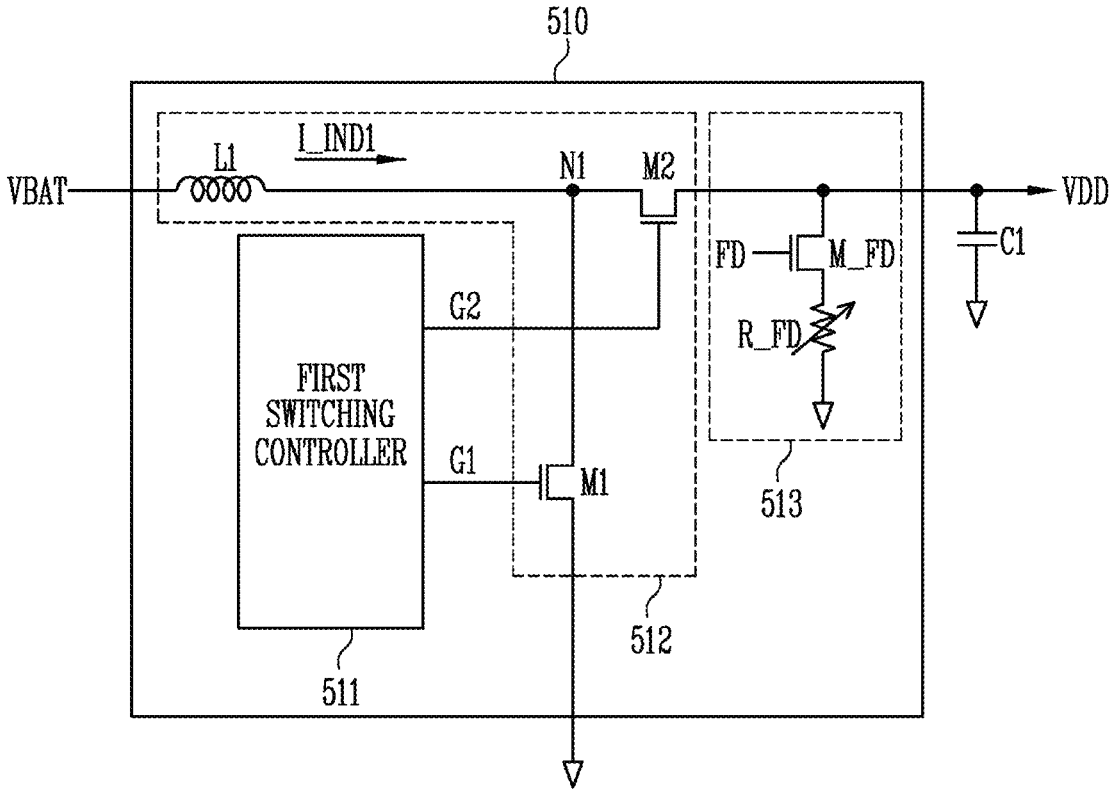
FIG. 4A is a circuit diagram illustrating an example of a first converter included in the power supply of FIG. 3.

FIG. 4A is a circuit diagram illustrating an example of the first converter 510 included in the power supply of FIG. 3.

Referring to FIG. 4A, the first converter 510 may include a first switching controller 511, a first switch unit 512, and a discharge unit 513 (or a discharge circuit).

The first converter 510 may convert the second external input voltage VBAT to output the first power voltage VDD.

The first switching controller 511 may generate a switching control signal including a first control signal G1 and a second control signal G2 and provide the switching control signal to the first switch unit 512. Although not shown in the drawing, the first control signal G1 and the second control signal G2 may be signals controlled by the power control signal CS of FIG. 3.

The first switch unit 512 may include a first inductor L1, a first transistor M1, and a second transistor M2.

The first inductor L1 may be connected between the first input terminal to which the second external input voltage VBAT is applied and a first node N1. The first power voltage VDD may be controlled based on a first inductor current I_IND1 flowing through the first inductor L1.

The first transistor M1 may be connected between the first node N1 and ground (or a ground voltage). The first transistor M1 may be turned on by receiving the first control signal G1 from the first switching controller 511 and control the first inductor current I_IND1 flowing through the first inductor L1.

The second transistor M2 may be connected between the first node N1 and a first output terminal from which the first power voltage VDD is output. The second transistor M2 may be turned on alternately with the first transistor M1. Therefore, after the first transistor M1 is turned on and electromotive force is generated in the first inductor L1, the second transistor M2 may be turned on so that a voltage of the first node N1 is converted into the first power voltage VDD. The second transistor M2 may be turned on by receiving the second control signal G2 from the first switching controller 511.

The discharge unit 513 may include a discharge transistor M_FD and a variable resistor R_FD. The discharge transistor M_FD and the variable resistor R_FD may be connected in series with each other between the first output terminal and the ground.

The discharge transistor M_FD may be turned on by receiving a discharge control signal FD during a switching period in which the displayed mode is switched from the normal mode to the power saving mode. In particular, the discharge control signal FD may be provided in the vertical blank period in which all pixels of the display panel do not display an image.

Here, the discharge control signal FD may be included in the power control signal CS of FIG. 3 and provided from the timing controller 400. For example, the discharge transistor M_FD may be turned on in response to the discharge control signal FD of a turn-on voltage level, and turned off in response to the discharge control signal FD of a turn-off voltage level.

The first converter 510 may turn on the discharge transistor M_FD in the switching period (in particular, the vertical blank period) to rapidly decrease the voltage level of the first power voltage VDD to the first power saving voltage level before entering the power saving mode. That is, since the voltage level of the first power voltage VDD may be changed before the power saving image is displayed, the luminance difference of the display image between the normal mode and the power saving mode due to the change of the voltage level of the first power voltage VDD may be prevented from being recognized to the user.

Figure 4B:
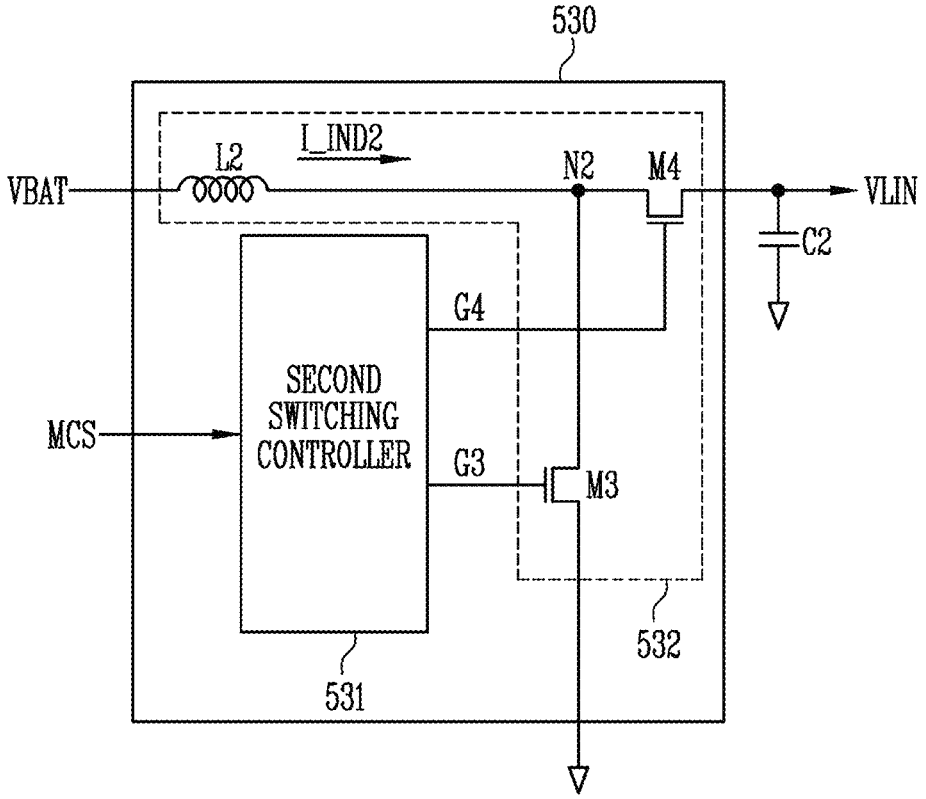
FIG. 4B is a circuit diagram illustrating an example of a third converter included in the power supply of FIG. 3.

FIG. 4B is a circuit diagram illustrating an example of the third converter 530 included in the power supply of FIG. 3.

Referring to FIG. 4B, the third converter 530 may include a second switching controller 531 and a second switch unit 532.

The third converter 530 may convert the second external input voltage VBAT to output the source driving voltage VLIN.

The second switching controller 531 may generate a switching control signal including a third control signal G3 and a fourth control signal G4 and provide the switching control signal to the second switch unit 532. Although not shown in the drawing, the third control signal G3 and the fourth control signal G4 may be signals controlled by the power control signal CS of FIG. 3.

The second switch unit 532 may include a second inductor L2, a third transistor M3, and a fourth transistor M4.

The second inductor L2 may be connected between a second input terminal to which the second external input voltage VBAT is applied and a second node N2. The source driving voltage VLIN may be controlled based on a second inductor current I_IND2 flowing through the second inductor L2.

The third transistor M3 may be connected between the second node N2 and the ground (or the ground voltage). The third transistor M3 may be turned on by receiving the third control signal G3 from the second switching controller 531 and control the second inductor current I_IND2 flowing through the second inductor L2.

The fourth transistor M4 may be connected between the second node N2 and a second output terminal from which the source driving voltage VLIN is output. The fourth transistor M4 may be turned on alternately with the third transistor M3. Therefore, after the third transistor M3 is turned on and electromotive force is generated in the second inductor L2, the fourth transistor M4 may be turned on so that a voltage of the second node N2 is converted into the source driving voltage VLIN. The fourth transistor M4 may be turned on by receiving the fourth control signal G4 from the second switching controller 531.

The third converter 530 may change a turn-on period of the third transistor M3 and the fourth transistor M4 according to the display mode (for example, the power saving mode and the normal mode). For example, the second switching controller 531 of the third converter 530 may receive a mode signal MCS, and a provision period of the third control signal G3 and the fourth control signal G4 may be controlled by the mode signal MCS. Here, the mode signal MCS may include data for the display mode of the display device 10, and the mode signal MCS may be included in the power control signal CS of FIG. 3 and provided from the timing controller 400.

As the third transistor M3 and the fourth transistor M4 alternately operate, power loss may occur due to internal configurations (for example, the second inductor L2). The third converter 530 may increase the turn-on period of the third transistor M3 and the fourth transistor M4 in the power saving mode longer than the turn-on period in the normal mode. That is, in the power saving mode, since the third transistor M3 and the fourth transistor M4 are turned on at less number of times per unit time than in the normal mode, the power loss of the display device 10 (or the power supply 500) according to switching of the third transistor M3 and the fourth transistor M4 may be minimized.

A specific control method of the turn-on period of the third transistor M3 and the fourth transistor M4 in the power saving mode will be described later in detail with reference to FIGS. 5 and 8.

Figure 5:
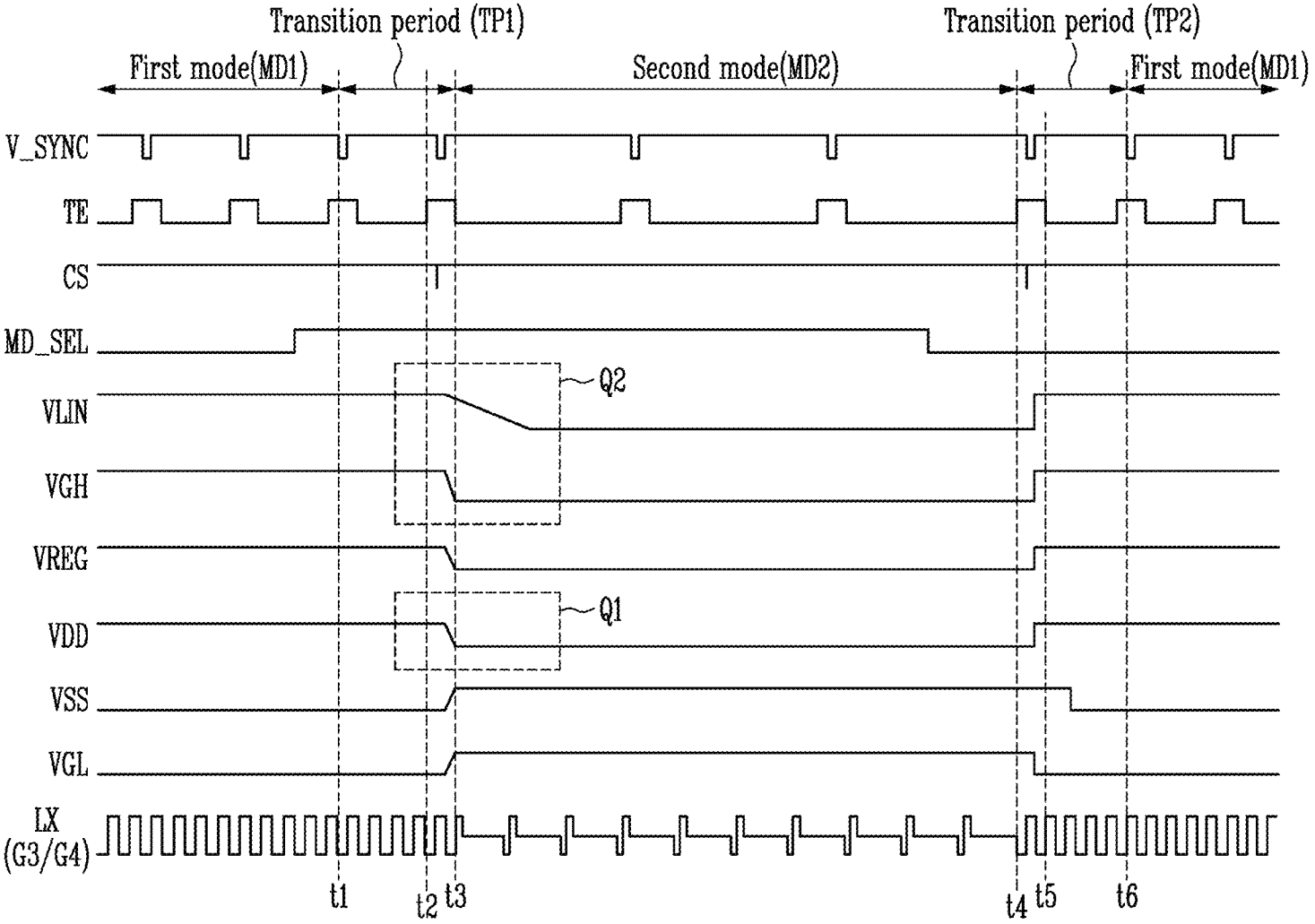
FIG. 5 is a waveform diagram illustrating an example of an operation of the display device of FIG. 1.
Figure 6:
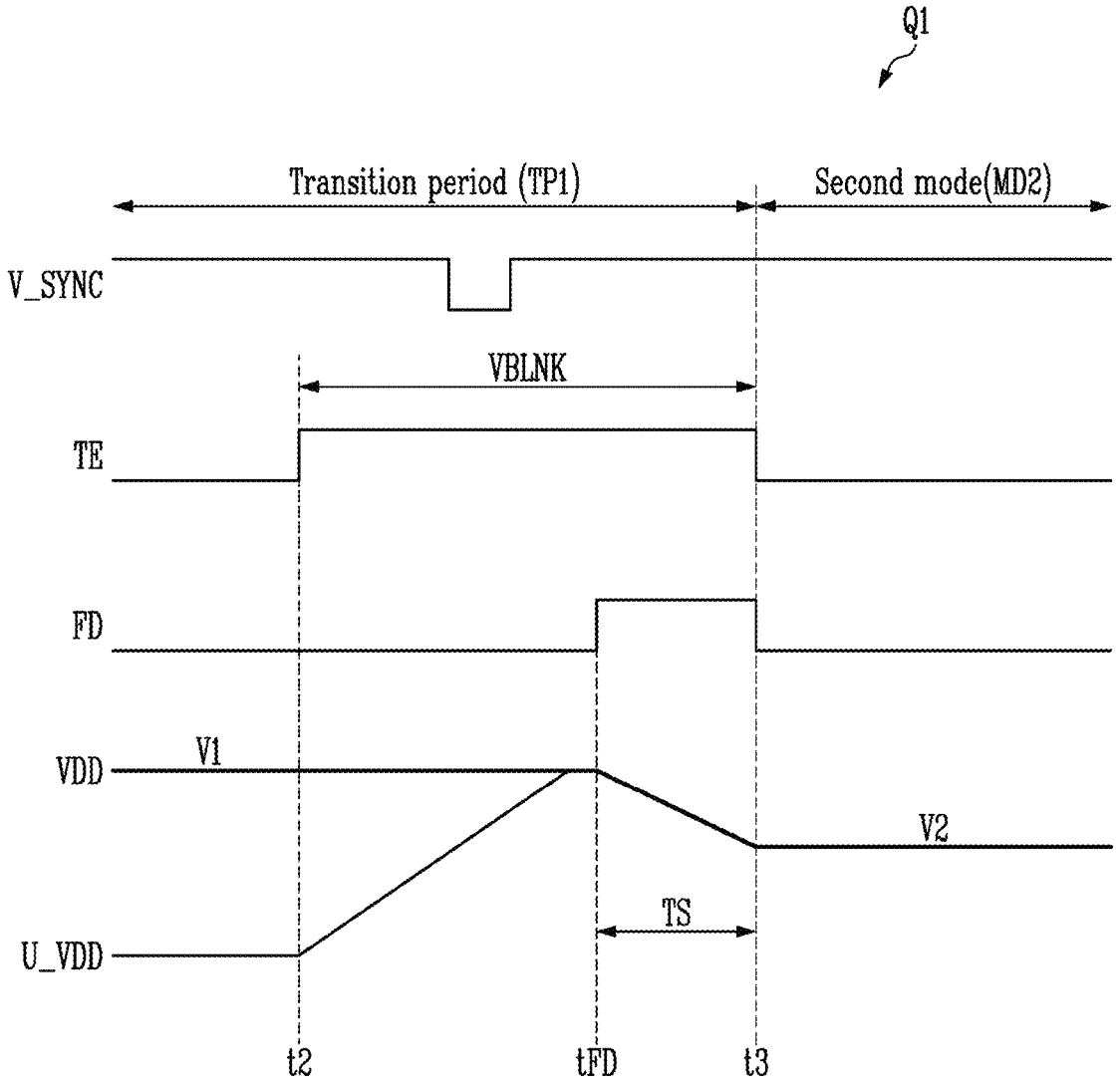
FIG. 6 is an enlarged waveform diagram of a Q1 region of FIG. 5 and is a diagram for describing a change of a first power voltage during a vertical blank period.
Figure 7:
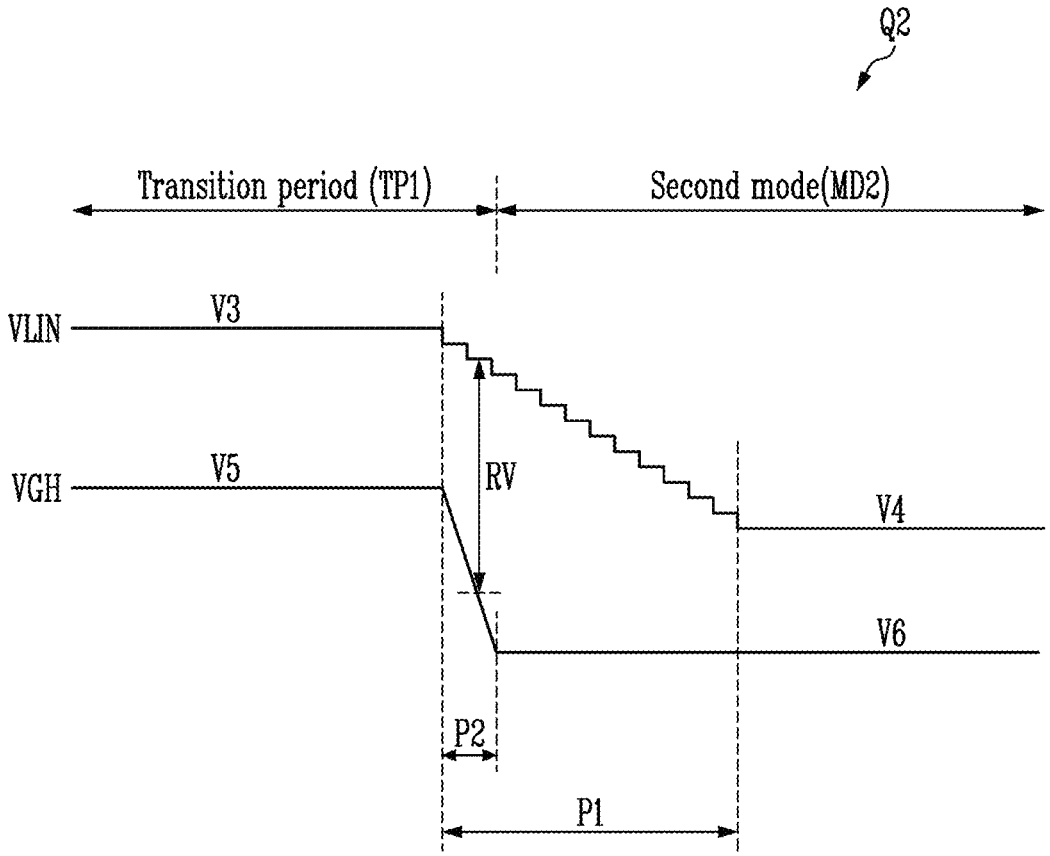
FIG. 7 is an enlarged waveform diagram of a Q2 region of FIG. 5 and is a diagram for describing a change of a source driving voltage and a first gate driving voltage.

FIG. 5 is a waveform diagram illustrating an example of an operation of the display device of FIG. 1. FIG. 6 is an enlarged waveform diagram of a Q1 region of FIG. 5 and is a diagram for describing a change of the first power voltage during the vertical blank period. FIG. 7 is an enlarged waveform diagram of a Q2 region of FIG. 5 and is a diagram for describing a change of the source driving voltage and the first gate driving voltage. FIG. 8 is a diagram for describing a change of the ripple voltage of the source driving voltage and the switching control signal in the power saving mode.

Referring to FIGS. 1 to 5, the display panel 100 may display the normal image in the normal mode MD1 (or First mode), display the power saving image of which the load is small in the power saving mode MD2 (or Second mode).

A mode control signal MD_SEL may be generally in a disable state in the normal mode MD1, and may be generally in an enable state in the power saving mode MD2.

When the mode control signal MD_SEL becomes in the enable state in the normal mode MD1, the mode of the display panel 100 may be switched to the power saving mode MD2 after a first switching period TP1 (i.e., transition period). In the power saving mode MD2, the mode control signal MD_SEL may be maintained as the enable state. Thereafter, when the mode control signal MD_SEL becomes in the disable state in the power saving mode MD2, the display panel 100 may be switched to the normal mode MD1 after a second switching period TP2 (i.e., transition period).

According to an embodiment, the display panel 100 may display a black image in the first switching period TP1 and the second switching period TP2. That is, black image data signal may be provided to the pixels PX of the display panel 100 in the first switching period TP1 and the second switching period TP2.

A vertical synchronization signal V_SYNC may be a signal indicating a start of image frames displayed by the display panel 100. A vertical blank signal TE may be provided overlapping the vertical synchronization signal V_SYNC. The vertical blank signal TE may be a signal defining the vertical blank period. Here, the vertical blank period may be a period in which the pixels PX of the display panel 100 do not display an image. For example, the vertical blank signal TE may be a signal defining a back dummy period of a previous image frame and a front dummy period of a current image frame. When the vertical blank signal TE is in a high level (or enable) state, all pixels PX of the display panel 100 may not display the display image (e.g., normal image and power saving image).

The power supply 500 and the data driver 300 of the display device 10 may generate various voltages to drive the display panel 100. The power supply 500 may generate the source driving voltage VLIN, the first power voltage VDD, and the second power voltage VSS, and the data driver 300 may generate the first gate driving voltage VGH, the second gate driving voltage VGL, and the gamma voltage VREG. Here, the source driving voltage VLIN, the first gate driving voltage VGH, the gamma voltage VREG, and the first power voltage VDD may be voltages having a positive voltage level, and the second power voltage VSS and the second gate driving voltage VGL may be voltages having a negative voltage level.

The voltages generated by the power supply 500 and the data driver 300 may have different voltage levels. For example, as shown in FIG. 5, the source driving voltage VLIN may have the greatest voltage level, while the first gate driving voltage VGH, the gamma voltage VREG, the first power voltage VDD, the second power voltage VSS, and the second gate driving voltage VGL may have gradually less voltage levels. That is, the second gate driving voltage VGL may have the lowest voltage level.

After the mode control signal MD_SEL becomes the enable state in the normal mode MD1, the first switching period TP1 may start in the next image frame. That is, as shown in FIG. 5, at a first time point t1, the first switching period TP1 may start, and the black image data signal may be provided to the pixels PX of the display panel 100.

Thereafter, at a second time point t2 to a third time point t3, the vertical blank signal TE may become in the enable state. As described above, when the vertical blank signal TE becomes in the enable state (or high level), all pixels PX of the display panel 100 may not display an image.

Between the second time point t2 and the third time point t3, the power supply 500 and the data driver 300 may change the voltage level of the generated voltages. As an embodiment, the power supply 500 and the data driver 300 may change the voltage level of the voltages in response to the power control signal CS.

FIG. 6 may be referenced to describe a change (for example, a voltage drop) of the first power voltage VDD between second time point t2 and the third time point t3.

Referring to FIGS. 4A and 6 additionally, in the vertical blank period VBLNK in which the vertical blank signal TE is in the enable state, the power supply 500 may decrease the voltage level of the first power voltage VDD. That is, the power supply 500 may stop generation and output of the first power voltage VDD. For example, the power supply 500 may decrease (for example, drop) the voltage level of the first power voltage VDD from a first reference voltage level V1 to a first power saving voltage level V2.

During the vertical blank period VBLNK, after the vertical synchronization signal V_SYNC is provided, the discharge control signal FD may be provided to the first converter 510 at a discharge time point tFD. As described above, when the discharge control signal FD is input, the discharge transistor M_FD of the first converter 510 may be turned on and thus the first power voltage VDD may be rapidly discharged. The discharge control signal FD may be enabled during a discharge period TS, and the discharge period TS may be within the vertical blank period VBLNK.

In addition, the data driver 300 may generate and output the first auxiliary power voltage U_VDD in the vertical blank period VBLNK. Since an output of the data driver 300 is relatively small compared to an output of the first converter 510, and a load of the power saving image is relatively small compared to the load of the normal image, even though the first power voltage VDD and the first auxiliary power voltage U_VDD are partially overlapped, an effect on the first converter 510 due to an operation of the data driver 300 may be negligible.

After the third time point t3, the first auxiliary power voltage U_VDD may be provided to the power line PL of the display panel 100 in the power saving mode MD2. At this time, a voltage level of the first auxiliary power voltage U_VDD may be the first power saving voltage level V2.

As described above, the black image data signal may be provided to the pixels PX of the display panel 100 in the first switching period TP1, but as the black image data signal is sequentially provided to pixel rows, the black image data signal may be provided to some of the pixels PX, and a normal image data signal (for example, a data signal of the normal image or the power saving image) may be provided to other pixels PX at the same time.

When the voltage level of the first power voltage VDD is changed (for example, dropped) while the normal image data signal is provided to the pixels PX, a driving current amount provided to the light emitting element of the pixels PX may be changed, and thus a luminance difference may occur in a display image displayed by some pixels PX or a display defect (for example, screen flickering or the like) may occur.

As described with reference to FIG. 6, since the power supply 500 changes the voltage level of the first power voltage VDD in the vertical blank period VBLNK in which all pixels PX do not display the image, the luminance difference of the display image between the normal mode and the power saving mode may be prevented from being recognized to the user.

In addition, the power supply 500 decreases the voltage level of the first power voltage VDD from the first reference voltage level V1 to the first power saving voltage level V2 in the power saving mode MD2, thereby minimizing power consumption.

Referring to FIG. 5 again, a voltage level of other voltages generated by the power supply 500 may be changed between the second time point t2 and the third time point t3. For example, the power supply 500 may decrease the voltage level of the source driving voltage VLIN. In addition, the power supply 500 may increase the voltage level of the second power voltage VSS. As described above, the second power voltage VSS may be a voltage having a negative voltage level, and the power supply 500 may decrease an absolute value of the voltage level of the second power voltage VSS.

The data driver 300 may decrease the voltage level of the first gate driving voltage VGH and the voltage level of the gamma voltage VREG, and decrease an absolute value of the voltage level of the second gate driving voltage VGL.

After the third time point t3, the display panel 100 may display the power saving image in the power saving mode MD2. In the power saving mode MD2, the power supply 500 and the data driver 300 may maintain the voltage levels of the first gate driving voltage VGH, the second gate driving voltage VGL, the gamma voltage VREG, the first power voltage VDD, and the second power voltage VSS, of which the voltage levels are changed.

However, the voltage level of the source driving voltage VLIN may gradually decrease in the power saving mode MD2. FIG. 7 may be referred to describe the change of the voltage level of the source driving voltage VLIN and the voltage level of the first gate driving voltage VGH.

Referring to FIG. 7 additionally, the power supply 500 may decrease (for example, drop) the voltage level of the source driving voltage VLIN from a second reference voltage level V3 to a second power saving voltage level V4 during a first period P1. The voltage level of the source driving voltage VLIN may gradually (or sequentially) decrease in a stepped manner during the first period P1. The data driver 300 may decrease (for example, drop) the voltage level of the first gate driving voltage VGH from a third reference voltage level V5 to a third power saving voltage level V6 during a second period P2.

The voltage level of the source driving voltage VLIN and the voltage level of the first gate driving voltage VGH may start to decrease at the same time point during the first switching period TP1. The voltage level of the source driving voltage VLIN may decrease during the first period P1, and the voltage level of the first gate driving voltage VGH may decrease during the second period P2 shorter than the first period P1. However, a change timing of the voltage level of the source driving voltage VLIN and the voltage level of the first gate driving voltage VGH according to the invention is not limited thereto. As another embodiment, the voltage level of the source driving voltage VLIN may start to decrease at a time point earlier than the decrease of the voltage level of the first gate driving voltage VGH. Even in this case, the voltage level of the source driving voltage VLIN may decrease during a period longer than the period of the decrease of the voltage level of the first gate driving voltage VGH.

The voltage level of the first gate driving voltage VGH may be changed within the first switching period TP1 and may be maintained thereafter, but the voltage level of the source driving voltage VLIN may be changed over the first switching period TP1 and some periods of the power saving mode MD2. Since the source driving voltage VLIN is not a voltage directly provided to the pixels PX of the display panel 100, even though the voltage level of the source driving voltage VLIN is changed during the power saving mode MD2 in which the display panel 100 displays the power saving image, a luminance difference may not occur or a display defect may not occur.

A voltage level difference of the source driving voltage VLIN (for example, a difference between the second reference voltage level V3 and the second power saving voltage level V4) may be equal to or greater than a voltage level difference of the first gate driving voltage VGH (for example, a difference between the third reference voltage level V5 and the third power saving voltage level V6), but the invention is not limited thereto. In another embodiment, the voltage level difference of the source driving voltage VLIN may be less than the voltage level difference of the first gate driving voltage VGH. As an embodiment, the voltage level of the source driving voltage VLIN (for example, the second power saving voltage level V4) after the voltage level change may be less than the voltage level of the first gate driving voltage VGH (for example, the third reference voltage level V5), but the invention is not limited thereto.

When the voltage level of the source driving voltage VLIN and the voltage level of the first gate driving voltage VGH decrease, a slew rate of the source driving voltage VLIN may be less than a slew rate of the first gate driving voltage VGH. Here, the slew rate of the source driving voltage VLIN may be proportional to a value obtained by dividing the voltage level difference of the source driving voltage VLIN (for example, the difference between the second reference voltage level V3 and the second power saving voltage level V4) by a voltage level change period (for example, the first period P1), and the slew rate of the first gate driving voltage VGH may be proportional to a value obtained by dividing the voltage level difference of the first gate driving voltage VGH (for example, the difference between the third reference voltage level V5 and the third power saving voltage level V6) by a voltage level change period (for example, the second period P2).

That is, different from the present embodiment, when the voltage level of the source driving voltage VLIN rapidly decreases for the same period as the voltage level of the first gate driving voltage VGH, a predetermined gap between the voltage level of the source driving voltage VLIN and the voltage level of the first gate driving voltage VGH may not be maintained, or a voltage inversion in which the voltage level of the first gate driving voltage VGH is higher than the voltage level of the source driving voltage VLIN may be generated. In this case, voltage generation and supply of the power supply 500 and the data driver 300 may become unstable, and a display defect problem may occur.

As described with reference to FIG. 7, the power supply 500 according to the present embodiment sequentially decreases the voltage level of the source driving voltage VLIN over a period longer than the period for decreasing the voltage level of the first gate driving voltage VGH. Therefore, the power supply 500 according to the present embodiment may maintain a difference between the voltage level of the source driving voltage VLIN and the voltage level of the first gate driving voltage VGH to be equal to or greater than a preset reference value RV, and may smoothly generate and supply voltages.

Referring to FIGS. 4B and 5, in the normal mode MD1 and the power saving mode MD2, the second switching controller 531 of the third converter 530 may output a switching control signal LX having a specific driving frequency. Here, the switching control signal LX shown in FIG. 5 may be one of the third control signal G3 and the fourth control signal G4 output by the second switching controller 531. For example, the switching control signal LX of FIG. 5 may be a signal corresponding to the fourth control signal G4, but the invention is not limited thereto. In another embodiment, may also be a signal corresponding to the third control signal G3. The second switching controller 531 may output the third control signal G3 and the fourth control signal G4 having a turn-on voltage level and a turn-off voltage level, respectively, at a specific period.

The third transistor M3 and the fourth transistor M4 may be alternately turn on in correspondence with the third control signal G3 and the fourth control signal G4, and source driving voltage VLIN may be controlled based on the second inductor current I_IND2 flowing through the second inductor L2.

In the normal mode MD1 and the power saving mode MD2, the second switching controller 531 may output the switching control signal LX at different periods. FIG. 8 may be referred to describe the different periods of the switching control signal LX in the normal mode MD1 and the power saving mode MD2.

Figure 8:
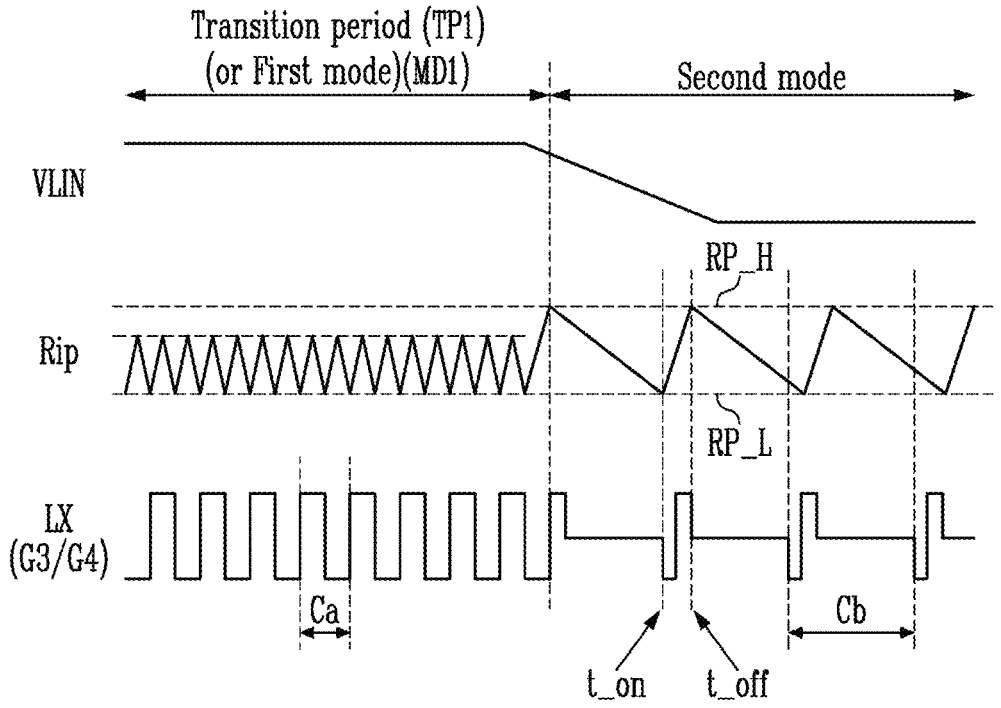
FIG. 8 is a diagram for describing a change of a ripple voltage of the source driving voltage and a switching control signal in a power saving mode.

Referring to FIG. 8 additionally, the third converter 530 of FIG. 4B may generate and supply the source driving voltage VLIN. When switching from the normal mode MD1 (or the First mode) to the power saving mode MD2 (or the Second mode), the third converter 530 may output the source driving voltage VLIN by decreasing the voltage level of the source driving voltage VLIN.

The second switching controller 531 of FIG. 4B of the third converter 530 may output the switching control signal LX having different periods in the normal mode MD1 (or the first switching period TP1) and in the power saving mode MD2. For example, in the normal mode MD1, the switching control signal LX may have a first period Ca, and in the power saving mode MD2, the switching control signal LX may have a second period Cb. As an embodiment, the second period Cb may be set to be longer than the first period Ca. That is, the number of times the third transistor M3 and the fourth transistor M4 are turned on per unit time in the normal mode MD1 may be greater than the number of times the third transistor M3 and the fourth transistor M4 are turned on per unit time in the power saving mode MD2. In some embodiments, the second switching controller 531 may output the switching control signal LX in response to the mode signal MCS. As described above, the mode signal MCS may be a signal including information on the normal mode MD1 and the power saving mode MD2.

When the number of times the third transistor M3 or the fourth transistor M4 is turned on per unit time decreases, a ripple voltage Rip of the source driving voltage VLIN may increase. Here, the ripple voltage Rip of the source driving voltage VLIN may mean an AC voltage component included in the source driving voltage VLIN. In the power saving mode MD2, since the display panel 100 displays the power saving image of which the load is small and a magnitude of the ripple voltage Rip may be proportional to a size of the load, the magnitude of the ripple voltage Rip may entirely decrease. In other words, since the load of the display image decreases, even though the number of times the transistors M3 and M4 turn on decreases and the magnitude of the ripple voltage Rip increases, since the magnitude of the ripple voltage Rip may be adjusted within a predetermined range, an abnormality may not occur in display quality of the display device.

In some embodiments, the ripple voltage Rip of the source driving voltage VLIN may be controlled within a predetermined range in the power saving mode MD2. For example, the second switching controller 531 may turn on the third transistor M3 or the fourth transistor M4 by providing the switching control signal LX of the turn-on level at an on-time point t_on at which the ripple voltage Rip of the source driving voltage VLIN becomes equal to or less than a first set value RP_L. In addition, the second switching controller 531 may turn off the third transistor M3 or the fourth transistor M4 by providing the switching control signal LX of the turn-off level at an off-time point t_off at which the ripple voltage Rip of the source driving voltage VLIN becomes equal to or greater than a second set value RP_H. Accordingly, the third converter 530 may decrease the number of times the third transistor M3 or the fourth transistor M4 turns on while maintaining a magnitude of the ripple voltage Rip of the source driving voltage VLIN at a constant level.

As described with reference to FIG. 8, the display device 10 may minimize power consumption by decreasing the number of times of switching (or number of times of turn-on) per unit time of the transistors M3 and M4 in the third converter 530. In addition, even though the number of times of switching per unit time of the transistors M3 and M4 decreases, since the ripple voltage of the source driving voltage may be controlled within a predetermined range, an abnormality does not occur in display quality.

Referring to FIG. 5 again, the state of the mode control signal MD_SEL may be changed to the disable state (or a low voltage level) during the power saving modes MD2. As described above, when the mode control signal MD_SEL becomes in the disable state, the display panel 100 may be switched to the normal mode MD1 after the second switching period TP2. In the second switching period TP2, the black image data signal may be provided to the pixels PX of the display panel 100.

In the second switching period TP2 of a fourth time point t4 to a sixth time point t6, the power supply 500 and the data driver 300 may change the voltage level of the generated voltages. As an embodiment, the power supply 500 and the data driver 300 may change the voltage level of the voltages in response to the power control signal CS.

Specifically, between the fourth time point t4 and a fifth time point t5, the vertical blank signal TE may become in the enable state. That is, all pixels PX of the display panel 100 may not display the display image (e.g., normal image or power saving image).

During an enable period of the vertical blank signal TE during the second switching period TP2, the power supply 500 may increase the voltage level of the source driving voltage VLIN. The voltage level of the source driving voltage VLIN may immediately increase, but the invention is not limited thereto. As another example, the voltage level of the source driving voltage VLIN may gradually increase during a period longer than a change period of the first gate driving voltage VGH.

In addition, the power supply 500 may increase the voltage level of the first power voltage VDD and decrease the voltage level of the second power voltage VSS, which is a negative voltage level. That is, the power supply 500 may increase an absolute value of the voltage level of each of the first power voltage VDD and the second power voltage VSS.

According to an embodiment, a voltage level change time point of the second power voltage VSS may be different from a voltage level change time point of the first power voltage VDD. For example, the voltage level of the second power voltage VSS may be changed after the voltage level of the first power voltage VDD is changed. As another example, the voltage level of the second power voltage VSS may be changed after the change of the voltage level of the second gate driving voltage VGL is completed. That is, the voltage level of the second power voltage VSS may be changed after the fifth time point t5.

During the enable period of the vertical blank signal TE during the second switching period TP2, the data driver 300 may change the voltage level of the first gate driving voltage VGH, the second gate driving voltage VGL, and the gamma voltage VREG. For example, the data driver 300 may increase the voltage level of the first gate driving voltage VGH and the voltage level of the gamma voltage VREG, and decrease the voltage level of the second gate driving voltage VGL, which is a negative voltage level. That is, the data driver 300 may increase an absolute value of the voltage level of each of the first gate driving voltage VGH, the second gate driving voltage VGL, and the gamma voltage VREG.

After the sixth time point t6, the second switching period TP2 may be ended, and the pixels PX of the display panel 100 may operate in the normal mode MD1 to display the normal image again.

As described with reference to FIGS. 5 to 8, since the display device 10 of the disclosure rapidly changes the voltage level of the first power voltage VDD within the vertical blank period VBLNK in which the vertical blank signal TE is enabled, a luminance difference between the normal mode and the power saving mode due to a voltage drop may be prevented from being recognized to the user. To this end, the display device 10 may provide the discharge control signal FD to the first converter 510 and rapidly discharge the first power voltage VDD through the discharge unit 513 of the first converter 510.

When switching from the normal mode MD1 to the power saving mode MD2, the display device 10 may gradually decrease the voltage level of the source driving voltage VLIN. Accordingly, the difference between the voltage level of the source driving voltage VLIN and the voltage level of the first gate driving voltage VGH may be maintained to be equal to or greater than the preset reference value RV, and driving stability of the display device 10 may be improved.

In addition, the display device 10 may minimize the power consumption by decreasing the number of times of switching (or the number of times of turn-on) per unit time of the transistors M3 and M4 in the third converter 530 in the power saving mode MD2 compared to the normal mode MD1.

Hereinafter, other embodiments of the display device will be described. In the following embodiments, the same components as the previously described embodiment will be referred to by the same reference numerals, description thereof will be omitted or simplified, and difference will be mainly described.

Figure 9:
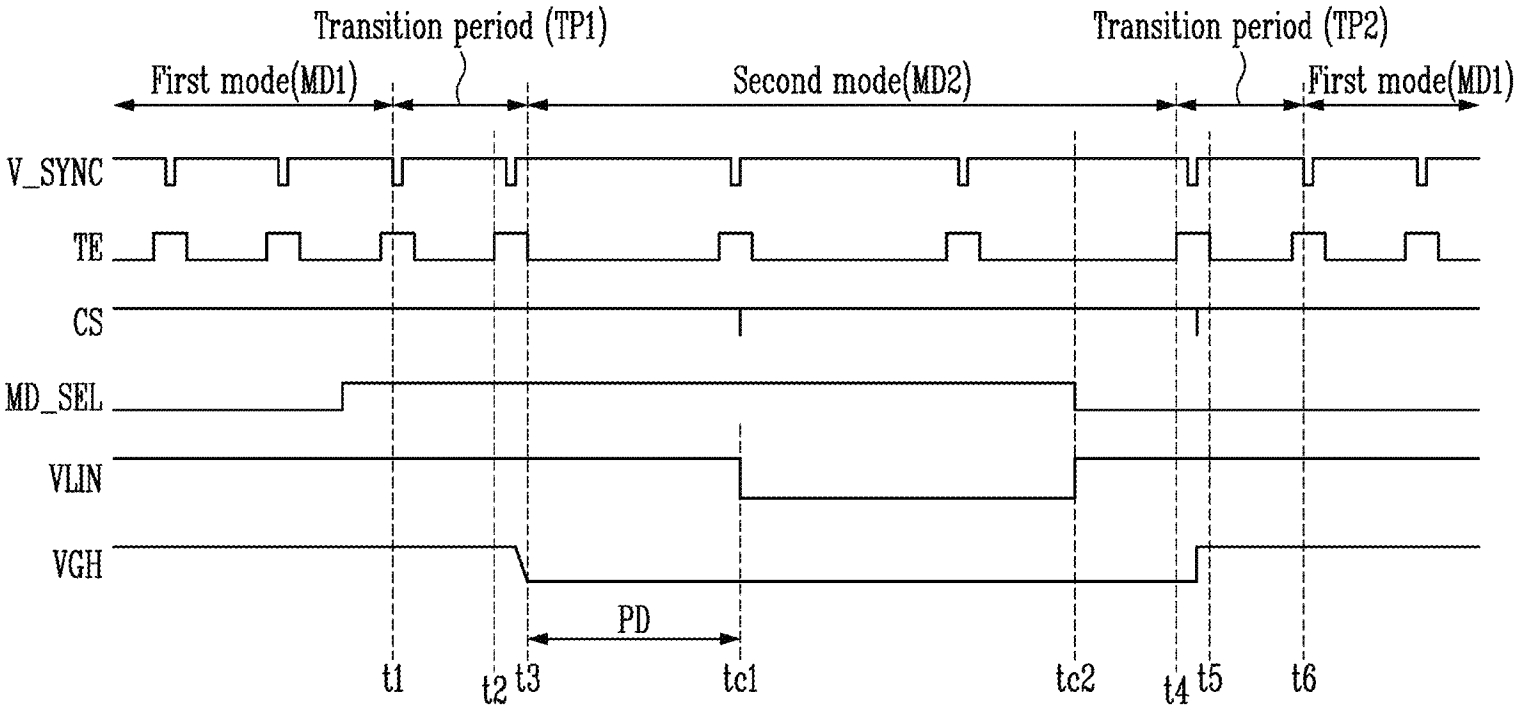
FIG. 9 is a waveform diagram illustrating another example of the operation of the display device of FIG. 1.

FIG. 9 is a waveform diagram illustrating another example of the operation of the display device of FIG. 1.

The embodiment of FIG. 9 is different from the embodiment of FIG. 5 in that the voltage level change time point of the source driving voltage VLIN is in the power saving mode MD2, and other configurations may be substantially the same or similar to the embodiment of FIG. 5.

Referring to FIG. 9, when switching from the normal mode MD1 to the power saving mode MD2 or from the power saving mode MD2 to the normal mode MD1, the voltage level of the source driving voltage VLIN may be changed during the power saving mode MD2.

Specifically, when switching from the normal mode MD1 to the power saving mode MD2, the data driver 300 may change the voltage level of the first gate driving voltage VGH within the first switching period TP1.

After the voltage level of the first gate driving voltage VGH is changed, the power supply 500 may change the voltage level of the source driving voltage VLIN in response to the power control signal CS. For example, the voltage level of the source driving voltage VLIN may be changed at a first change time point tc1 when a delay period PD passes after the voltage level of the first gate driving voltage VGH is changed. Here, the first change time point tc1 may be a time point in the power saving mode MD2. As an embodiment, the voltage level of the source driving voltage VLIN may decrease in a next image frame after the voltage level of the first gate driving voltage VGH is changed. That is, the delay period PD between a change time point of the first gate driving voltage VGH (e.g., t3) and the change time point of the source driving voltage VLIN (e.g., tc1) may be a period corresponding to one image frame. However, the delay period PD according to the invention is not limited thereto, and may be a period corresponding to a period of two or more image frames in another embodiment.

Thereafter, when switching from the power saving mode MD2 to the normal mode MD1, the data driver 300 may change the voltage level of the first gate driving voltage VGH within the second switching period TP2. The voltage level of the source driving voltage VLIN may not be changed in the second switching period TP2, and may be changed in the power saving mode MD2 before the first gate driving voltage VGH is changed. As an embodiment, the source driving voltage VLIN may be changed together with the mode control signal MD_SEL at a second change time point tc2 at which the mode control signal MD_SEL becomes the disable state in the power saving mode MD2.

As described with reference to FIG. 9, since the change time points of the voltage level of the source driving voltage VLIN and the voltage level of the first gate driving voltage VGH do not overlap with each other, even though the source driving voltage VLIN is immediately changed within a short period, a sufficient gap may be maintained between the voltage level of the source driving voltage VLIN and the voltage level of the first gate driving voltage VGH, and the display device 10 may be stably driven.

Figure 10:
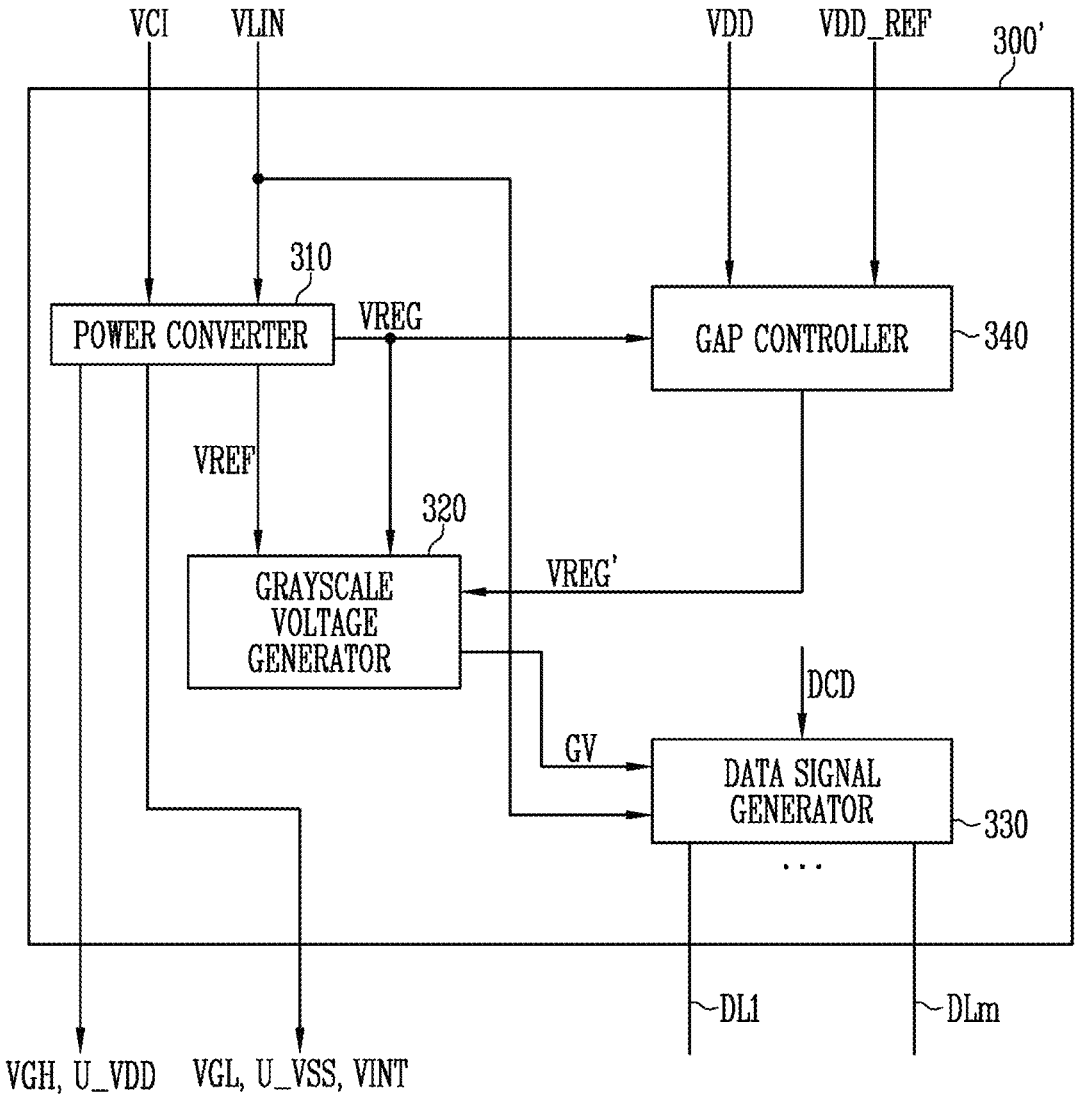
FIG. 10 is a diagram illustrating another example of the data driver included in the display device of FIG. 1.
Figure 11:
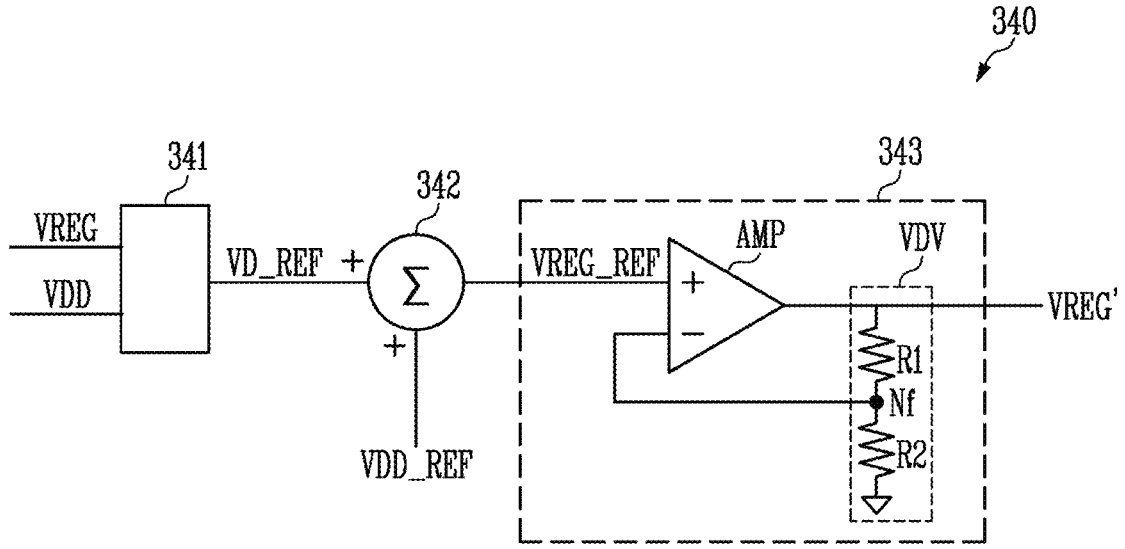
FIG. 11 is a diagram illustrating an example of a gap controller included in the data driver of FIG. 10.
Figure 12:
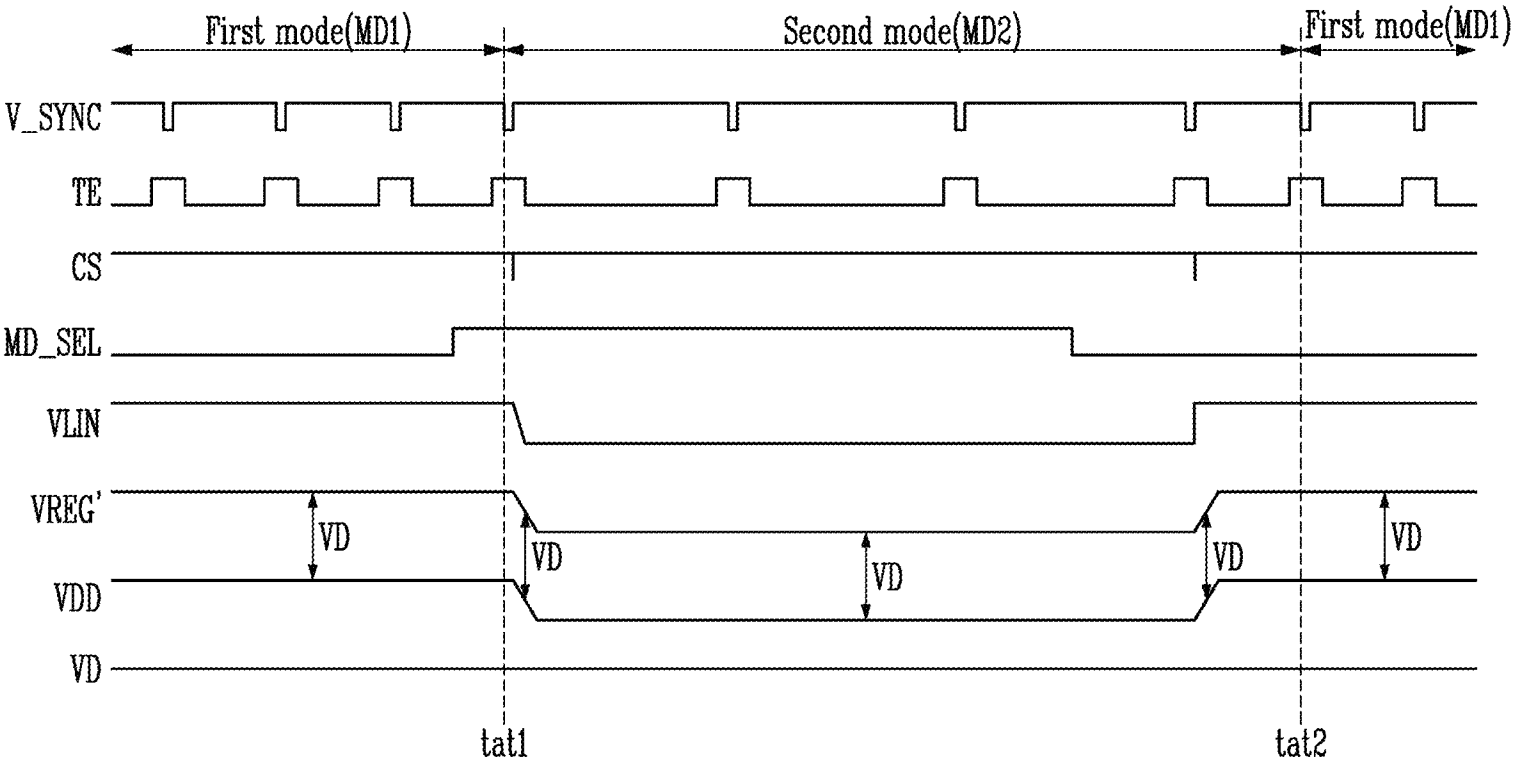
FIG. 12 is a waveform diagram illustrating an operation of a display device including the data driver of FIG. 10.

FIG. 10 is a diagram illustrating the data driver according to another embodiment. FIG. 11 is a diagram illustrating an example of a gap controller included in the data driver of FIG. 10. FIG. 12 is a waveform diagram illustrating an operation of a display device including the data driver of FIG. 10.

The data driver 300' according to the embodiment of FIG. 10 is different from the data driver 300 according to the embodiment of FIG. 2 in that the data driver 300' according to the embodiment of FIG. 10 further includes the gap controller 340 for maintaining a gap between the first power voltage VDD and the gamma voltage VREG, and other configurations may be substantially the same or similar. Hereinafter, difference from the embodiment of FIGS. 2 to 5 will be mainly described.

Referring to FIGS. 1 and 10 to 12, the data driver 300' may include the gap controller 340.

The gap controller 340 may receive the first power voltage VDD, a first gamma voltage VREG, and a reference power voltage VDD_REF. At this time, the reference power voltage VDD_REF may be a separately set value. The reference power voltage VDD_REF may be a preset value provided in a manufacturing process of the display device or a value provided by the user after manufacturing the display device.

The gap controller 340 may generate a second gamma voltage VREG' (or an adjusted first gamma voltage) based on the first power voltage VDD, the first gamma voltage VREG, and the reference power voltage VDD_REF. At this time, the second gamma voltage VREG' may be a voltage that maintains a constant gap (or difference) from the first power voltage VDD. The gap controller 340 may provide the generated second gamma voltage VREG' to the grayscale voltage generator 320.

The grayscale voltage generator 320 may generate the grayscale voltages GV based on the reference voltage VREF and the second gamma voltage VREG' provided from the gap controller 340, and provide the grayscale voltages GV to the data signal generator 330.

According to an embodiment, the gap controller 340 may further receive a gap control enable signal (not shown) from the outside. When the gap controller 340 becomes in an enable state by the control signal, the grayscale voltage generator 320 may generate the grayscale voltages GV based on the second gamma voltage VREG', and when the gap controller 340 becomes in a disable state by the control signal, the grayscale voltage generator 320 may generate the grayscale voltages GV based on the first gamma voltage VREG.

Even though the voltage level of the first power voltage VDD is changed according to the display mode, the gap controller 340 may adjust a voltage level of the second gamma voltage VREG' so that a difference VD of voltage levels of the first power voltage VDD and the second gamma voltage VREG' may be maintained to be constant.

Specifically, as shown in FIG. 11, the gap controller 340 may include a first driver 341, a second driver 342, and a third driver 343.

The first driver 341 may receive the first gamma voltage VREG and the first power voltage VDD, and generate a reference voltage difference VD_REF proportional to the difference between the first gamma voltage VREG and the first power voltage VDD. The first driver 341 may be configured as a comparator. To this end, the first driver 341 may include an operational amplifier and the like.

In some embodiments, when a digital signal for the first gamma voltage VREG and the first power voltage VDD is applied to the first driver 341, the first driver 341 may include a digital-to-analog converter to generate the reference voltage difference VD_REF by converting the digital signals for the first gamma voltage VREG and the first power voltage VDD into corresponding analog signals.

The second driver 342 may generate a reference gamma voltage VREG_REF by summing the reference voltage difference VD_REF received from the first driver 341 and the reference power voltage VDD_REF input from the outside.

The third driver 343 may output the second gamma voltage VREG' based on the reference gamma voltage VREG_REF received from the second driver 342. The reference gamma voltage VREG_REF provided to the third driver 343 may have a decreased voltage level at a predetermined ratio to prevent internal circuit elements from being damaged in a voltage control process. Accordingly, the third driver 343 may amplify the reference gamma voltage VREG_REF at the same rate as the decrease ratio to generate the second gamma voltage VREG', and output the second gamma voltage VREG' to the grayscale voltage generator 320.

In an embodiment, the third driver 343 may be configured as a non-inverting amplifier. To this end, the third driver 343 may include an amplifier AMP and a voltage divider VDV.

The amplifier AMP may include a first input terminal receiving the reference gamma voltage VREG_REF, a second input terminal receiving a feedback voltage of the second gamma voltage VREG', and an output terminal outputting the second gamma voltage VREG'. Here, the first input terminal may be a positive input terminal, and the second input terminal may be a negative input terminal, but the invention is not limited thereto.

The voltage divider VDV may include a plurality of resistors R1 and R2, and may feedback a portion of the second gamma voltage VREG' output to the output terminal toward the second input terminal. That is, the voltage divider VDV may be connected to the output terminal and the second input terminal to provide a feedback voltage of the second gamma voltage VREG' to the second input terminal of the amplifier AMP.

As described above, the amplifier AMP and the voltage divider VDV of the third driver 343 may configure the non-inverting amplifier, and the reference gamma voltage VREG_REF input to the first input terminal may be amplified according to a ratio of the resistors R1 and R2 included in the voltage divider VDV and output to the output terminal. For example, the second gamma voltage VREG' may be a voltage output by amplifying the reference gamma voltage VREG_REF by (1+R2/R1) times.

Although not shown in the drawing, the power supply 500 may receive the reference power voltage VDD_REF from the outside. The power supply 500 may include an amplifying circuit including an amplifier (for example, a non-inverting amplifier). The power supply 500 may amplify the reference power voltage VDD_REF to generate an adjusted first power voltage VDD' and provide the adjusted first power voltage VDD' to the display panel 100.

As described with reference to FIGS. 10 to 12, even though the voltage level of the first power voltage VDD is changed, since the difference VD between the voltage levels of the second gamma voltage VREG' and the first power voltage VDD is maintained to be constant by the gap controller 340, a driving current amount provided to the light emitting element of the pixel PX may be maintained to be constant. That is, even though the voltage level of the first power voltage VDD is changed, a luminance difference does not occur in the image displayed by the display panel 100 and switching between the normal mode and the power saving mode may be performed without a separate switching period in which a black image data signal is provided to the pixels PX.

Although the embodiments of the disclosure have been described with reference to the accompanying drawings, it will be understood by those skilled in the art to which the disclosure pertains that the embodiments may be implemented in other specific forms without changing the technical spirit and essential features of the disclosure. Therefore, it should be understood that the embodiments described above are illustrative and are not restrictive in all aspects.

What is claimed is:

1. A display device comprising:

a display panel which includes a plurality of pixels and a power line, and displays an image in a normal mode or a power saving mode;

a data driver which provides a data signal to the pixels; and a power supply which supplies a source driving voltage to the data driver and supplies a first power voltage to the power line in the normal mode, wherein the data driver supplies a first auxiliary power voltage to the power line in the power saving mode, the power supply outputs the first power voltage by decreasing a voltage level of the first power voltage to a first power saving voltage level in a vertical blank period of a first switching period, the pixels do not display an image in the vertical blank period, and the first switching period is a transition period from the normal mode to the power saving mode.

2. The display device according to claim 1, wherein the power supply comprises a first converter which generates the first power voltage, the first converter comprises:

a switch unit including a first inductor and first and second transistors and connected between a first input terminal to which an external input voltage is applied and a first output terminal from which the first power voltage is output; and a discharge circuit connected between the first output terminal and ground and including a variable resistor and a discharge transistor, and the first converter alternately turns on the first and second transistors to output the first power voltage.

3. The display device according to claim 2, wherein the discharge transistor is turned on in response to a discharge control signal provided in the vertical blank period, and the first converter decreases the voltage level of the first power voltage to the first power saving voltage level after the discharge control signal is provided.

4. The display device according to claim 1, wherein the power supply comprises a second converter which generates the source driving voltage, the second converter comprises:

a second inductor connected between a second input terminal to which an external input voltage is applied and a node;

a third transistor connected between the node and ground and which is turned on in response to a first control signal;

a fourth transistor connected between a second output terminal from which the source driving voltage is output and the node and which is turned on in response to a second control signal; and a switching controller which generates a switching control signal including the first control signal and the second control signal, and a first period in which the switching control signal is provided in the normal mode is different from a second period in which the switching control signal is provided in the power saving mode.

5. The display device according to claim 4, wherein the second period is set to be longer than the first period.

6. The display device according to claim 5, wherein in the power saving mode, when a ripple voltage of the source driving voltage is equal to or less than a first set value, the switching controller turns on the third transistor or the fourth transistor, and when the ripple voltage of the source driving voltage is equal to or greater than a second set value, the switching controller turns off the third transistor and the fourth transistor.

7. The display device according to claim 1, wherein the display panel displays a normal image in the normal mode, and displays a power saving image having a load less than a load of the normal image in the power saving mode, the pixels display the normal image at a first driving frequency in the normal mode, and the pixels display the power saving image at a second driving frequency less than the first driving frequency in the power saving mode.

8. The display device according to claim 1, further comprising:

a gate driver which provides a gate signal to the pixels, wherein the data driver generates the first auxiliary power voltage and a gate driving voltage based on the source driving voltage, and the gate driver generates the gate signal based on the gate driving voltage.

9. The display device according to claim 8, wherein when switching from the normal mode to the power saving mode, the power supply outputs the source driving voltage by decreasing a voltage level of the source driving voltage to a second power saving voltage level during a first period, the data driver outputs the gate driving voltage by decreasing a voltage level of the gate driving voltage to a third power saving voltage level during a second period shorter than the first period, and a difference between the voltage level of the source driving voltage and the voltage level of the gate driving voltage maintains a preset reference value or more.

10. The display device according to claim 9, wherein the voltage level of the source driving voltage gradually decreases in a stepped manner over the first period.

11. The display device according to claim 9, wherein when the source driving voltage and the gate driving voltage decrease, a slew rate of the source driving voltage is less than a slew rate of the gate driving voltage.

12. The display device according to claim 8, wherein the power supply outputs the source driving voltage by decreasing a voltage level of the source driving voltage in the power saving mode after the first switching period, and the data driver outputs the gate driving voltage by decreasing a voltage level of the gate driving voltage in the first switching period.

13. The display device according to claim 12, wherein the power supply decreases the voltage level of the source driving voltage in a next frame after the voltage level of the gate driving voltage decreases.

14. The display device according to claim 12, wherein the power supply increases the voltage level of the source driving voltage in response to a mode control signal in the power saving mode, and the data driver increases the voltage level of the gate driving voltage in a second switching period changing from the power saving mode to the normal mode.

15. The display device according to claim 1, wherein the data driver provides a black image data signal to the pixels in the first switching period.

16. A display device comprising:

a display panel which includes a plurality of pixels and a power line and displays an image in a normal mode or a power saving mode;

a data driver which provides a data signal to the pixels; and a power supply which supplies a source driving voltage to the data driver and supplies a first power voltage to the power line in the normal mode, wherein the data driver generates a first auxiliary power voltage and a first gamma voltage based on an external input voltage and the source driving voltage, the data driver supplies the first auxiliary power voltage to the power line in the power saving mode, in a period changing from the normal mode to the power saving mode, the data driver outputs the first gamma voltage by decreasing a voltage level of the first gamma voltage, and the power supply outputs the first power voltage by decreasing a voltage level of the first power voltage, and in the normal mode and the power saving mode, a difference between the voltage level of the first power voltage and the voltage level of the first gamma voltage is constant.

17. The display device according to claim 16, wherein the data driver comprises:

a power converter which generates the first auxiliary power voltage and the first gamma voltage using the source driving voltage;

a grayscale voltage generator which generates grayscale voltages based on the first gamma voltage; and a data signal generator which generates the data signal based on the grayscale voltages and the source driving voltage.

18. The display device according to claim 17, wherein the data driver further comprises a gap controller which generates a second gamma voltage of which a voltage level is adjusted based on the first gamma voltage, the first power voltage, and a reference power voltage, and the grayscale voltage generator generates the grayscale voltages based on the second gamma voltage.

19. The display device according to claim 18, wherein the gap controller comprises:

a first driver which compares the first gamma voltage with the first power voltage to generate a reference voltage difference;

a second driver which sums the reference voltage difference and the reference power voltage to generate a reference gamma voltage; and a third driver which outputs the second gamma voltage based on the reference gamma voltage.

20. The display device according to claim 19, wherein the third driver comprises:

an amplifier including a first input terminal connected to the second driver to receive the reference gamma voltage, a second input terminal which receives a feedback voltage of the second gamma voltage, and an output terminal which outputs the second gamma voltage; and a voltage divider connected to the output terminal and the second input terminal and which provides the feedback voltage of the second gamma voltage to the second input terminal of the amplifier.

* * * * *